US011679930B1

(12) United States Patent
Craig et al.

(10) Patent No.: US 11,679,930 B1
(45) Date of Patent: Jun. 20, 2023

(54) TANK CONTAINER

(71) Applicant: Quality Carriers, Inc., Tampa, FL (US)

(72) Inventors: Steven Craig, Jasper, GA (US); Stephan Strydom, Uitenhage/Kariega (ZA); Timothy Neil McLaren, Port Elizabeth (ZA)

(73) Assignee: QUALITY CARRIERS, INC., Tampa, FL (US)

( * ) Notice: Subject to any disclaimer, the term of this patent is extended or adjusted under 35 U.S.C. 154(b) by 0 days.

(21) Appl. No.: 17/580,515

(22) Filed: Jan. 20, 2022

(51) Int. Cl.

| | |
|---|---|
| ***B65D 88/12*** | (2006.01) |
| ***B65D 88/54*** | (2006.01) |
| ***B65D 90/00*** | (2006.01) |
| ***B65D 90/24*** | (2006.01) |
| ***B65D 90/30*** | (2006.01) |

(52) U.S. Cl.
CPC ..... *B65D 88/128* (2013.01); *B65D 88/54* (2013.01); *B65D 90/0033* (2013.01); *B65D 90/24* (2013.01); *B65D 90/30* (2013.01); *B65D 2588/54* (2013.01); *B65D 2588/74* (2013.01); *B65D 2590/24* (2013.01)

(58) Field of Classification Search
CPC ..... B65D 90/12; B65D 90/02; B65D 88/129; B65D 88/128; B65D 88/28; B65D 19/44; B65D 2588/54
USPC ..... 220/1.5
See application file for complete search history.

(56) References Cited

U.S. PATENT DOCUMENTS

| | | | | |
|---|---|---|---|---|
| 6,244,288 | B1 * | 6/2001 | Pettesch | F16K 27/07 137/267 |
| 6,834,689 | B1 | 12/2004 | Peters | |
| 10,060,101 | B2 * | 8/2018 | Plummer | F16K 17/363 |
| 2010/0187192 | A1 * | 7/2010 | Ness | B65D 88/10 211/71.01 |
| 2013/0333897 | A1 * | 12/2013 | Wells | E21B 41/0021 166/93.1 |
| 2018/0291578 | A1 * | 10/2018 | Webster | E01H 5/102 |
| 2020/0140190 | A1 * | 5/2020 | Van Laarhoven | B65D 88/06 |

OTHER PUBLICATIONS

Girard Equipment USA, 45 Deg TTMA Bottom and Top Valves Owners Manual; Feb. 20, 2018 (Year: 2018).*
"Girard Equipment USA 45 Deg TTMA Bottom and Top Valves Owner's Manual GQ81300 and GQ81350." https://girardequip.com/wp-content/uploads/2019/07/QF-830-009-45-Degree-TTMA-Bottom-and-Top-Valves-Owners-Manual-Rev-A-1.pdf published Feb. 20, 2018, (21 pages).

(Continued)

*Primary Examiner* — Anthony D Stashick
*Assistant Examiner* — Raven Collins
(74) *Attorney, Agent, or Firm* — Quarles & Brady LLP

(57) ABSTRACT

A tank container includes a frame having a front end opposite a rear end that defines a rear plane, a vessel extending between the front end and the rear end of the frame, and a discharge valve assembly. The discharge valve assembly comprises an internal bottom valve, an adaptor, and a discharge valve. The internal bottom valve is positioned within an interior volume of the vessel and the discharge valve is positioned entirely within the frame and offset at least one inch from the rear plane. The adaptor curves downwardly between the internal bottom valve and the discharge valve.

20 Claims, 15 Drawing Sheets

(56) References Cited

OTHER PUBLICATIONS

"Girard Equipment, Inc. GE Hydraulic Hand Pump Gen 2 Assembly"—https://girardequip.com/product/ge-hydraulic-hand-pump-gen2-assembly/ published Aug. 9, 2021 (5 pages).
"Girard Equipment, Inc. GE GVRA Y-tube Assembly"—https://girardequip.com/product/ge-gvra-y-tube-assembly/, published May 5, 2020 (4 pages).
"Girard Equipment, Inc. GVRAB2"—https://girardequip.com/product/gvrab2/ published Oct. 29, 2020 (7 pages).
Girard Main Catalog 2019—https://girardequip.com/wp-content/uploads/2019/09/Main-Catalog_2019.pdf, published Sep. 2019 (50 pages).
"Girard Equipment, Inc. HydraFlo RDV Steam Jacketed"—https://girardequip.com/product/gh50002/, published Nov. 6, 2020 (6 pages).
"Girard Equipment, Inc. 702004 EZ-Clean Compression TEF Ferrule"—https://girardequip.com/product/702004/, published May 18, 2020 (4 pages).
"Girard Equipment, Inc. HydraFlo Valve Sheet"—http://girardequip.com/wp-content/uploads/2019/06/HydraFlo-Solution-Sheet-Final-1.pdf, published Jun. 2019 (2 pages).
"Girard Equipment, Inc. GE Chemovation Internal "Top Hat" Assembly"—https://girardequip.com/product/gq87000/ published Aug. 2019 (6 pages).
"Girard Equipment, Inc. GE 4 "X2" TTMA Sump Mounting Pad, Machined"—https://girardequip.com/product/gp40110/, published Mar. 2019 (5 pages).
"21000 liters T7 Tank Container"—https://www.tankcon.com/EN/21000-liters-T7-tank-container-TCSU-100502-1, published Nov. 7, 2019 (14 pages).

* cited by examiner

TANK CONTAINER

RELATED APPLICATIONS

N/A

BACKGROUND

Field of the Disclosure

This disclosure relates generally to tank containers for transporting, storing, and dispensing contents, e.g., liquids.

Description of the Background of the Disclosure

Tank containers are used for transporting, storing, and dispensing contents, e.g., liquids, across various distances by various means. Tank containers are designed and constructed of various sizes, shapes, materials, and with various features. Further, tank containers are subject to certain regulations, standards, and codes relating to their sizes, capacities, strengths, etc.

SUMMARY

Various aspects are described in connection with the illustrative implementations of a tank container disclosed herein.

In one aspect, a tank container includes a frame having a front end opposite a rear end that defines a rear plane, a vessel extending between the front end and the rear end of the frame, and a discharge valve assembly that is located at the rear end of the frame and coupled to the vessel. The discharge valve assembly further comprises an internal bottom valve, an adaptor, and a discharge valve that has an outlet. The internal bottom valve is at least partially positioned within an interior volume of the vessel and the discharge valve is positioned entirely within the frame and offset from the rear plane. The adaptor curves downwardly between the internal bottom valve and the discharge valve.

In some embodiments, the adaptor is configured to position the discharge valve below the internal bottom valve. The adaptor includes an inner flange and an outer flange. Further, the inner flange can be disposed at about a 45 degree angle relative to the outer flange. The adaptor includes a curved body that narrows in diameter between the inner flange and the outer flange. Additionally, the outer flange of the adaptor includes a plurality of apertures spaced radially and a plurality of tabs arranged on a first side of the outer flange. Further, each of the apertures of the outer flange of the adaptor are configured to receive a fastener therethrough and a head of the fastener is configured to be received between two of the tabs. In another embodiment, the outer flange of the adaptor includes a plurality of apertures and a plurality of slots arranged on a first side of the outer flange. Further, each of the apertures of the outer flange of the adaptor are configured to receive a fastener therethrough and a head of the fastener is configured to be received within one of the slots. The discharge valve is operably connected to a heating system.

In another aspect, a tank container includes a vessel having a front dished end opposite a rear dished end and a shell extending between the front dished end and the rear dished end. The tank container further includes a frame that at least partially surrounds the vessel and defines a front end, a rear end, a curb side, and a street side. Further, the tank container includes a discharge valve that is located adjacent the rear dished end and has an internal bottom valve mounted to the shell. Additionally, the tank container includes a spill box that is located on a top end of the shell of the vessel. The spill box including a street side wall and a curb side wall. A drain is connected to the street side wall of the spill box and a drain pan extends approximately half of a distance between the street side wall and the curb side wall within the spill box.

In some embodiments, the drain pan is sloped downwardly from the curb side wall to the shell. A plurality of appurtenances is arranged on the shell proximate the street side wall of the spill box. Further, the appurtenances are spaced apart from the drain pan. A lid is positioned on the shell within the spill box and intersected by a longitudinal axis that bisects the tank container. The drain pan extends between the longitudinal axis and the curb side wall of the spill box, and the longitudinal axis intersects the lid. The longitudinal axis is positioned between the drain pan and the drain.

In still another aspect, a tank container includes a vessel having an interior volume, a frame that is connected to the vessel at a front end and a rear end, a vapor recovery system, and a discharge valve assembly. The discharge valve assembly and the vapor recovery system are both operably connected to a hydraulic pumping system.

In some embodiments, the hydraulic pumping system includes a hand pump that is mounted to a lower side rail of the frame at a curb side of the tank container. The vapor recovery system includes a hydraulic pipeline that has a first branch and a second branch, the first branch being coupled to a vapor recovery adaptor that is located at a top end of the tank container, and the second branch being coupled to an internal bottom valve of the discharge valve assembly. Further, the discharge valve assembly includes a discharge valve that is operably coupled to a steam heating system.

In still another aspect, a tank container includes a vessel having an interior volume, a frame that is connected to the vessel at a front end by a front ring mounting assembly and at a rear end by a rear ring mounting assembly. The front ring mounting assembly comprises a front reinforcement flange that connects the front end of the frame to a front dished end of the vessel. The rear ring mounting assembly comprises a rear reinforcement flange that connects the rear end of the frame to a rear dished end of the vessel. The vessel is offset longitudinally toward the front end of the frame to allow a longitudinal space for housing a bottom discharge assembly extending from the rear dished end toward the rear end within the frame. The front and rear ring mounting assemblies are configured to accommodate the vessel being offset longitudinally toward the front end.

In some embodiments the rear ring mounting assembly has a side reinforcing end that varies in thickness to accommodate a shell thickness.

DETAILED DESCRIPTION

Before any embodiments are explained in detail, it is to be understood that the embodiments disclosed herein are not limited to the details of construction and the arrangement of components set forth in the following description or illustrated in the following drawings. The embodiments of the present disclosure are capable of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless specified or limited otherwise, the terms "mounted," "connected," "supported," and "coupled" and variations thereof are used broadly and encompass both direct and indirect mountings, connections, supports, and couplings. Further, "connected" and "coupled" are not restricted to physical or mechanical connections or couplings.

The term "about," as used herein, refers to variations in the numerical quantity that may occur, for example, through typical measuring and manufacturing procedures used for a tank container with a frame and appurtenances or other articles of manufacture that may include embodiments of the disclosure herein; through inadvertent error in these procedures; through differences in the manufacture, source, or purity of the ingredients used to make the compositions or mixtures or carry out the methods; and the like. Throughout the disclosure, the terms "about" and "approximately" refer to a range of values ±5% of the numeric value that the term precedes.

Figure 1:
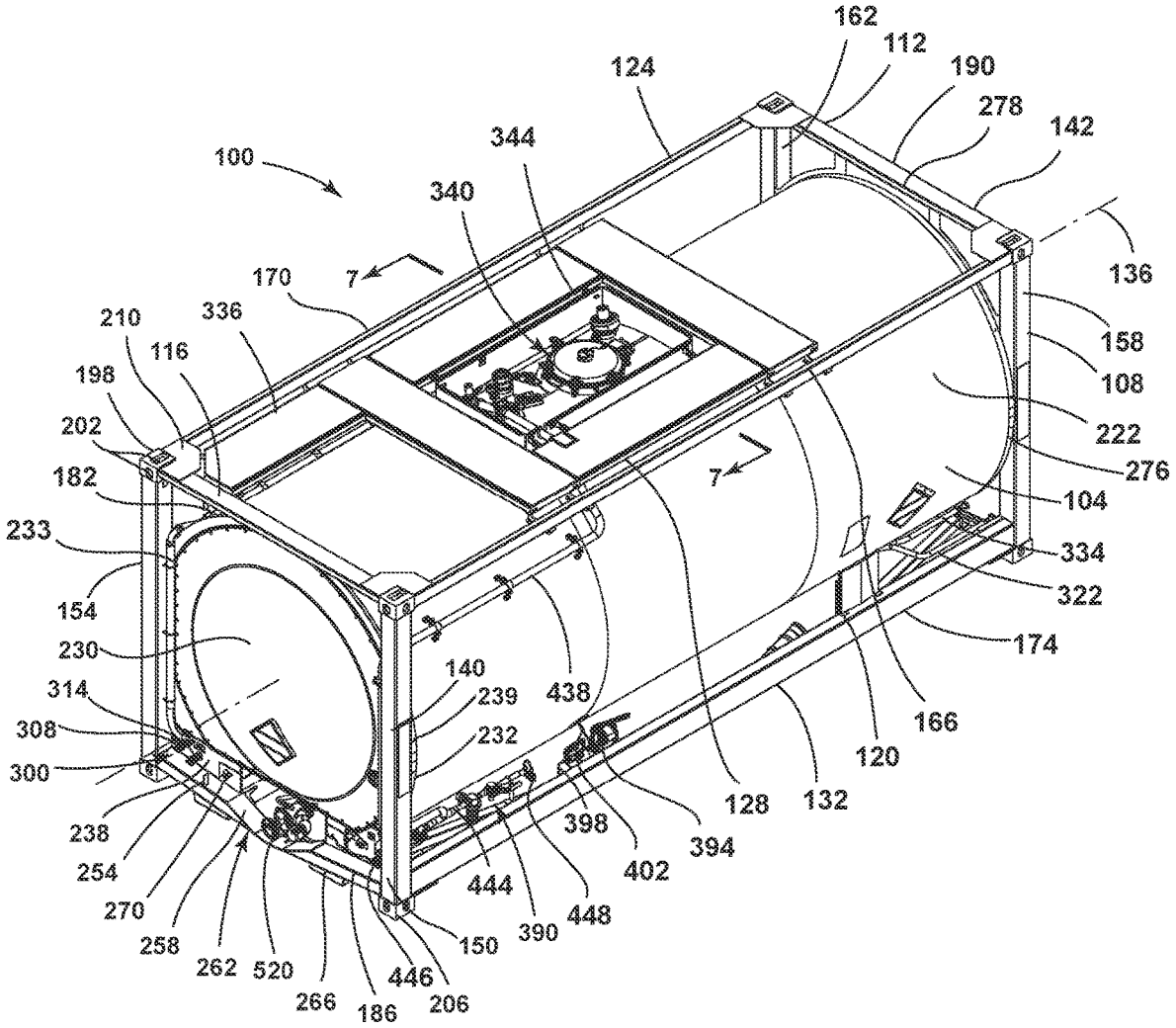
FIG. 1 is a perspective view of a top, right, and rear side of a tank container according to an embodiment of the present disclosure.

FIG. 1 illustrates an embodiment of a tank container 100 including a vessel 104 that is mounted to a frame 108. The tank container 100 includes a front end 112 opposite a rear end 116, a curb side 120 opposite a street side 124, and a top end opposite a bottom end 132. It will be appreciated that the front end 112, rear end 116, curb side 120, street side 124, top end 128, and bottom end 132 are regions of the tank container 100 which may be referenced with respect to one or more components, e.g., the vessel 104 or the frame 108, of the tank container 100 for reference. Further, it will be appreciated that the curb side 120 corresponds to the right-hand side of the tank container 100 and the street side 124 corresponds to the left-hand side of the tank container 100 when viewed from a vantage point facing the rear end 116, as in FIG. 1. Thus, the terms right, right-hand, and curb side are synonymous for purposes of the present disclosure. In a similar fashion, the terms left, left-hand, and street side are synonymous for purposes of the present disclosure.

The tank container 100 of the present disclosure is configured for road transportation, e.g., conveyance on a commercial vehicle along roads and highways, as well as for rail transportation, e.g., conveyance along railroads, which collectively may be referred to as ground transportation. Further, the tank container 100 is designed for international and domestic travel by way of ground transportation, but not for water transportation, e.g., conveyance on a vessel across oceans and waterways. Thus, for purposes of the present disclosure, it will be understood that the tank container 100 is designed for ground-only transportation, i.e., suited only for ground transportation and not for water transportation. As such, the tank container 100 and, specifically, the vessel 104 are designed in compliance with the American Society of Mechanism Engineers (ASME) VIII Division 1 standards and also with various U.S. Department of Transportation (USDOT) regulations, e.g., U.S. 49 C.F.R. § 180.407 ("USDOT 407"). In addition, unlike ground-only transport tank containers that are compliant with USDOT regulations, the frame 108 is fashioned in compliance with the International Organization for Standardization (ISO) Standard 1496/3, the International Convention for Safe Container (CSC), and the Convention on International Transport of Goods Under Cover of TIR Carnets (TIR). Further, the frame 108 is designed to be Transport Canada (TC) Impact Approved. Accordingly, the tank container 100 of the present disclosure combines a frame that is designed and constructed for compliance with ISO standards and international regulations with a vessel that is designed and constructed for domestic standards and regulations.

Referring to FIG. 1, the tank container 100 defines a longitudinal axis 136 that intersects the rear end 116 and the front end 112 to bisect the tank container 100, such that the curb side 120 is located opposite the street side 124 relative to the longitudinal axis 136. Accordingly, the longitudinal axis 136 extends in a longitudinal direction, i.e., in a front-to-rear or rear-to-front direction, and also in a vertical direction, i.e., top-to-bottom or bottom-to-top direction. The tank container 100 defines a rear plane 140 at the rear end 116 and, in particular, the frame 108 defines the rear plane 140 at the rear end 116. The rear plane 140 is disposed orthogonally relative to the longitudinal axis 136, such that the rear plane 140 extends in the vertical direction and in a lateral direction, i.e., curb side-to-street side or street side-to-curb side. The tank container 100 also defines a front plane 142 at the front end 112 and, in particular, the frame 108 defines the front plane 142 at the front end 112. The front plane 142 is disposed orthogonally relative to the longitudinal axis 136, such that the front plane 142 extends in the vertical direction and in a lateral direction, i.e., curb side-to-street side or street side-to-curb side. The front plane 142 and the rear plane 140 extend parallel with one another and the vessel 104 is positioned closer to the front plane 142 at the front end 112 than to the rear plane 140 at the rear end 116, such that the vessel 104 is offset toward the front end 112 within the frame 108.

Figure 2:
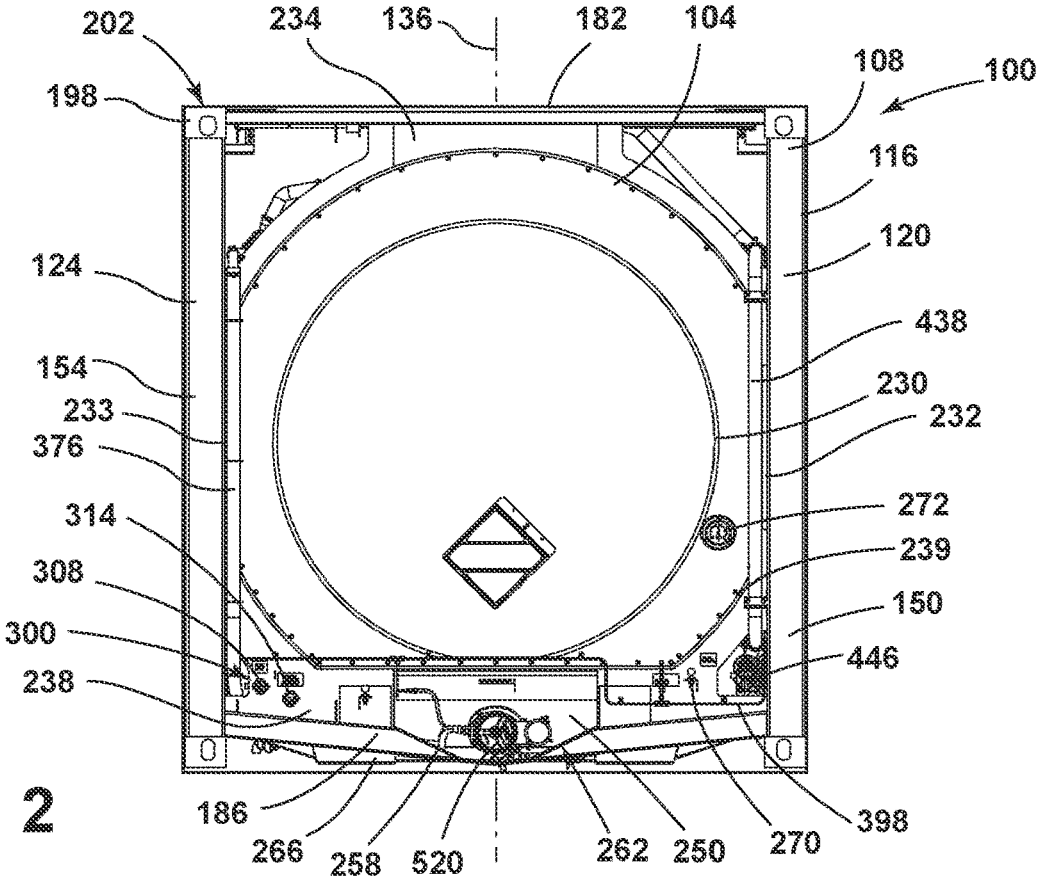
FIG. 2 is a rear elevational view of the tank container of FIG. 1.
Figure 3:
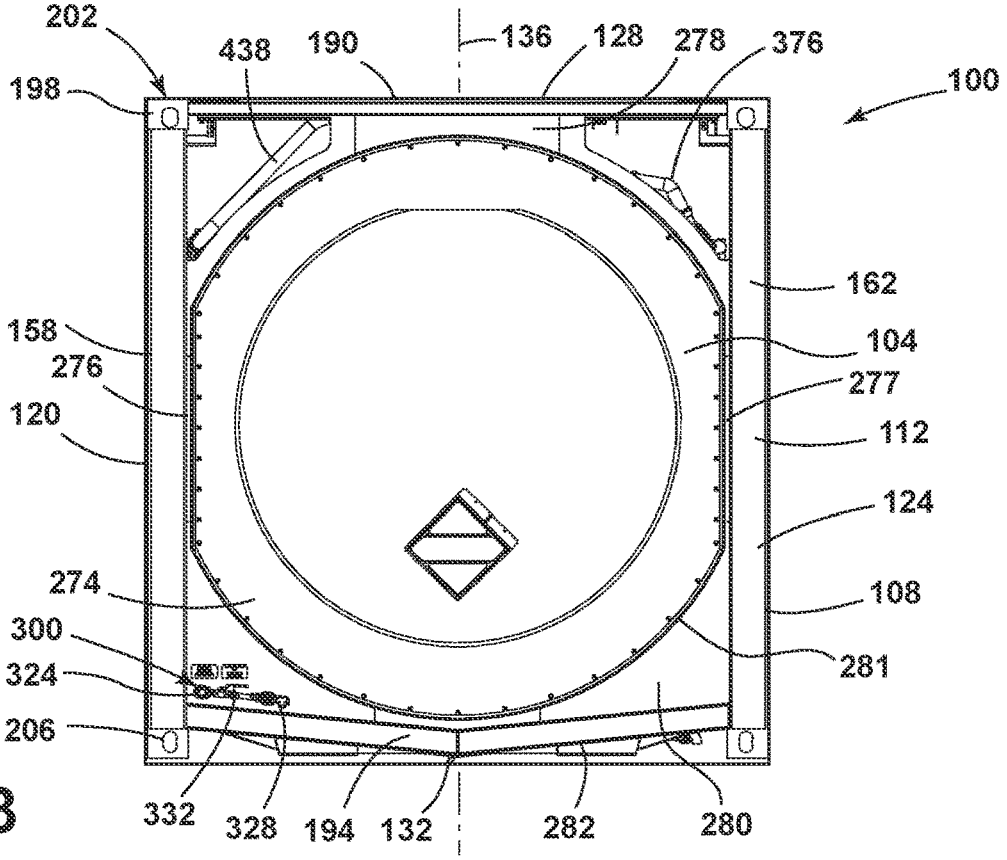
FIG. 3 is a front elevational view of the tank container of FIG. 1.

With reference to FIGS. 1-3, the frame 108 is a generally rectangular prism-shaped structure including a pair of rear vertical members 150, 154 at the rear end 116 and a pair of front vertical members 158, 162 at the front end 112. The rear vertical members 150, 154 are generally parallel and coextensive with each other, and the front vertical members 158, 162 are generally parallel and coextensive with each other. Upper side rails 166, 170 extend between the rear vertical members 150, 154 and the front vertical members 158, 162, and the upper side rails 166, 170 are located at the top end 128 of the tank container 100. The upper side rails 166, 170 are generally parallel and coextensive with each other. Further, lower side rails 174, 178 extend between the rear vertical members 150, 154 and the front vertical members 158, 162 at the bottom end 132 of the tank container 100. The lower side rails 174, 178 are generally parallel and coextensive with each other and also extend substantially parallel with the upper side rails 166, 170.

With reference to FIGS. 1-3, the frame 108 comprises a rear upper cross-member 182 that extends between the rear vertical members 150, 154 and the upper side rails 166, 170 at the rear end 116 and the top end 128. Further, a rear bottom cross-member 186 extends between the rear vertical members 150, 154 and the lower side rails 174, 178 at the rear end 116 and the bottom end 132. Also, a front upper cross-member 190 extends between the front vertical members 158, 162 and the upper side rails 166, 170 at the front end 112 and the top end 128, while a front bottom cross-member 194 (see FIG. 3) extends between the front vertical members 158, 162 and the lower side rails 174, 178 at the front end 112 and the bottom end 132. A plurality of corners 198 are formed at intersections among the aforementioned members of the frame 108. Each corner 198 includes features for rigging, i.e., lifting holes or eyes 202, that are formed on or through the corners 198 of the frame 108. In addition, feet 206 extend from the corners 198 at the bottom end 132 of the frame 108 for supporting the tank container 100 on ground surfaces and/or for engagement with a vehicle chassis and/or securing mounts. The frame 108 is also configured to be stacked on top of or underneath other tank containers. To that end, stacking plates 210 are provided in the form of metal plates at each corner 198 of the top end 128 (see FIG. 1) and reinforcement plates 212 are located each corner 198 of the bottom end 132 (see FIG. 6) of the frame 108. In the illustrated embodiment, the stacking plates 210 extend between the upper side rails 166, 170 and respective front and rear upper cross-members 182, 190. The stacking plates 210 promote stacking of other vessels or assemblies, which may be differently sized or shaped, upon the tank container 100 and further allow for guidance into a proper alignment to prevent mis-stacking and damage of the tank container 100.

Figure 5:
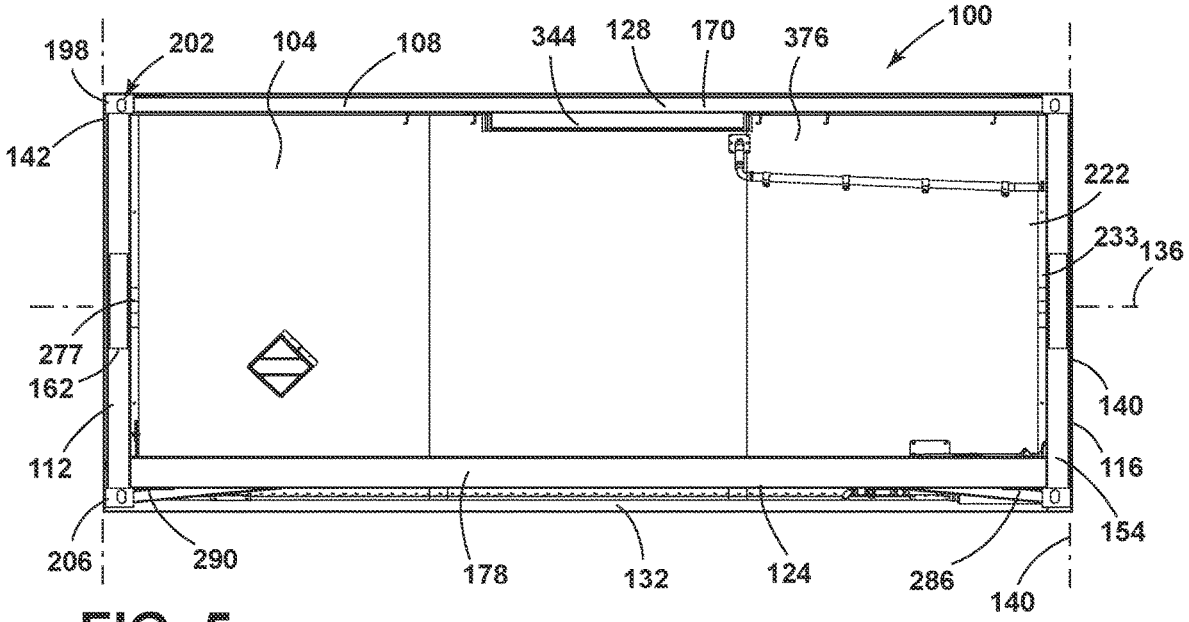
FIG. 5 is a left side elevational view of the tank container of FIG. 1.
Figure 6:
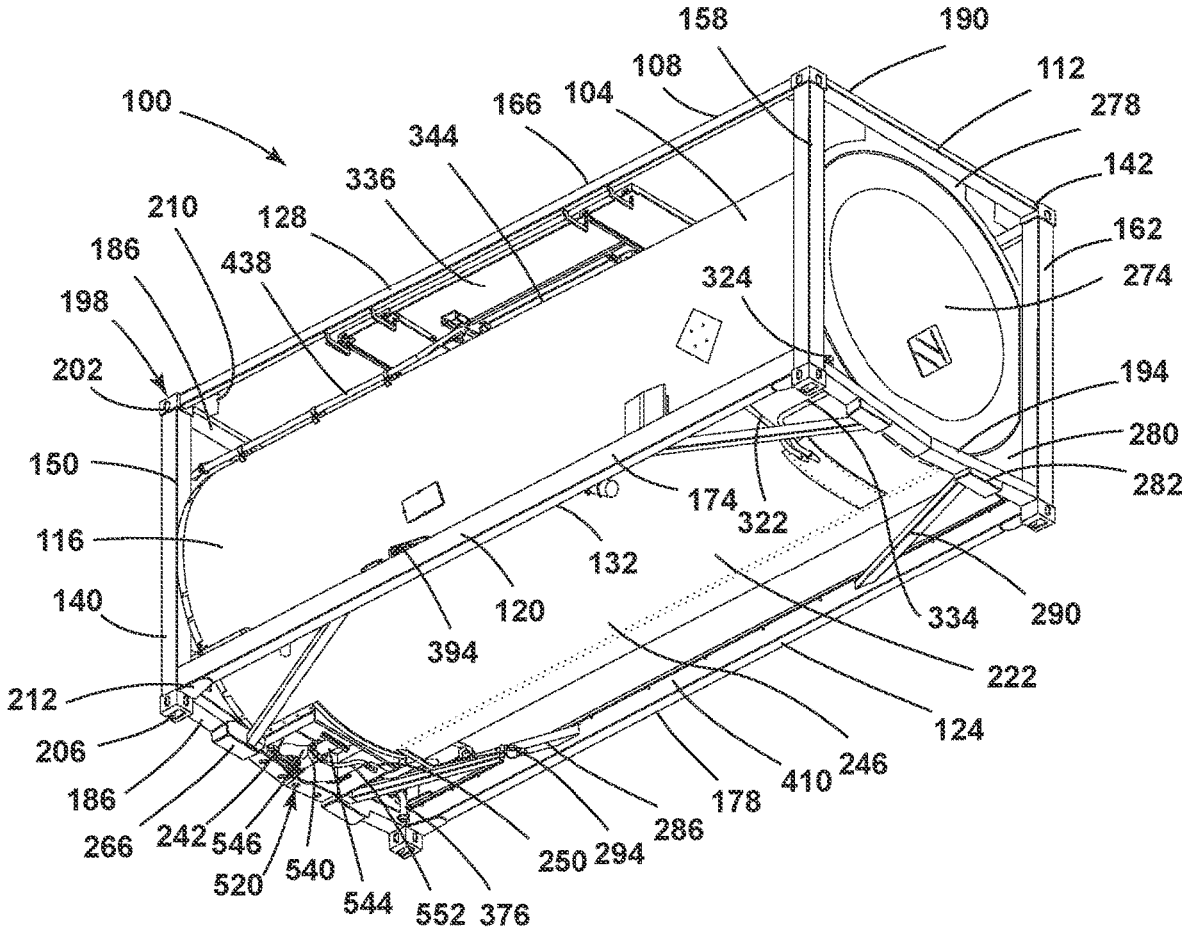
FIG. 6 is a perspective view of a bottom, right, and front side of the tank container of FIG. 1.
Figure 7:
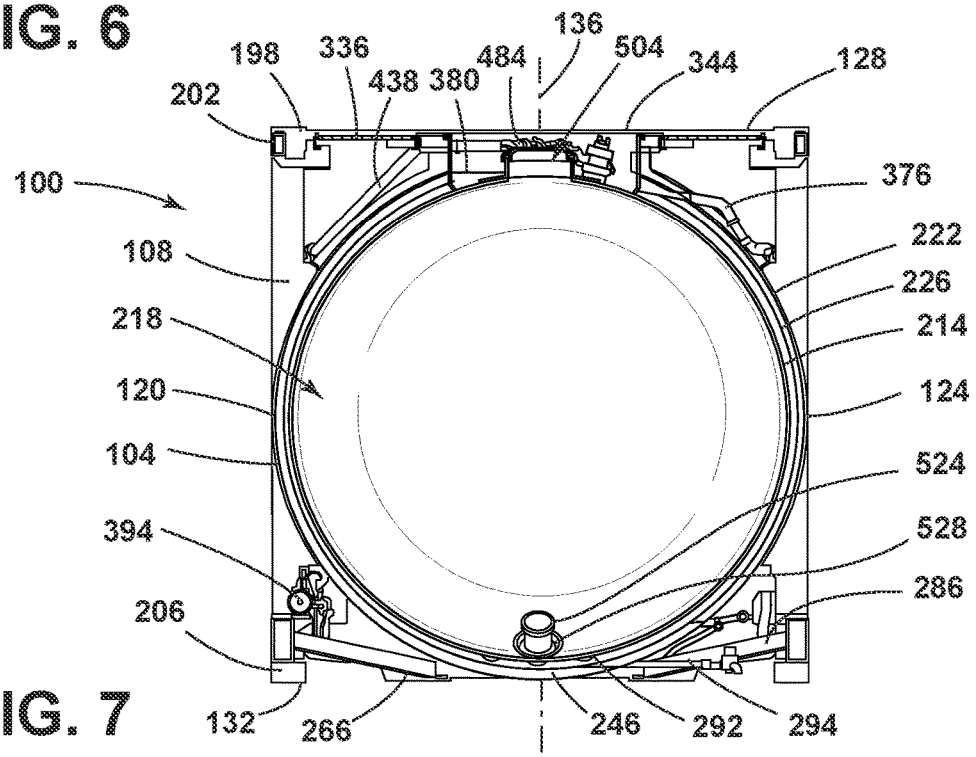
FIG. 7 is a cross-sectional view of the tank container taken along line 7-7 of FIG. 1.

With reference to FIGS. 1-8, the vessel 104 includes a generally cylindrical shell 214 that defines an internal volume 218 and that is surrounded by a plurality of cladding panels 222 (see FIG. 7). Further, the cladding panels 222 are attached to one another and to the shell 214 to form a spacing 226 between the shell 214 and the cladding 222. The shell 214 is insulated with polyurethane panels having a thickness of about 75 mm (about 3 inches), although other configurations are possible. Further, the cladding panels 222 are provided in the form of high impact panels having a thickness of about 1.6 mm (about 0.0625 inch) that are painted with a glass fiber reinforced plastic and/or resin. All joints and/or seams of the cladding panels 222 are sealed with silicone. In some embodiments, a stainless steel retaining belt (not shown) is provided on the cladding panels 222 near the dished ends 230, 274.

In this particular embodiment, the vessel 104 is configured for the storage and transportation of various forms of liquids, including viscous and non-viscous liquids, with a nominal capacity of 21,200 L (about 5,600 gals). Accordingly, the shell 214 has a wall thickness of at least about 4.2 mm (about 0.17 inch). Further, the wall thickness of the shell 214 is designed to accommodate a corrosion tolerance or allowance of about 0.2 mm (about 0.0079 inch). The shell 214 is manufactured of stainless steel material, e.g., 316L, in compliance with ASTM SA 316, or SANS 50028-7 Type 1.4402 or Type 1.4404, or equivalents. In some embodiments, the shell 214 has a surface finish in the form of a 2B that is achieved by cold rolling, in compliance with the standard specification ASTM A480 or equivalents, although other processes and surface finishes are contemplated. The shell 214 is constructed to be resilient and durable, such that the shell 214 achieves a joint coefficient of 0.85 measured by non-destructive testing methods in accordance with ASME VIII.

As illustrated in FIGS. 1 and 2, the rear end 116 of the vessel 104 includes a rear dished end 230 that is connected to the frame 108. In the illustrated embodiment, the rear dished end 230 of the vessel 104 is connected to the rear vertical members 150, 154 by side reinforcing ends or members 232, 233, respectively, which have a thickness that can vary based on the wall thickness of the shell 214 and the position of the vessel 104 relative to the frame 108, e.g., thicker side reinforcing ends 232, 233 accommodate the vessel 104 being offset toward the front end 112 of the frame 108. Further, the rear dished end 230 is attached to the rear upper cross-member 182 of the frame 108 by a rear reinforcing flange 234 extending therebetween. That is, the vessel 104 is attached to the rear upper cross-member 182 by the reinforcing flange 234, which may be attached by welding, fastening, or the like. Further, rear skirts 238 are provided between portions of the rear dished end 230 and the rear bottom cross-member 186. The rear reinforcing flange 234, rear reinforcing skirts 238, and side reinforcing members 232, 233 comprise a rear ring mounting assembly 239 that secures the rear dished end 230 of the vessel 104 to the frame 108 at the rear end 116. As illustrated in FIG. 2, the rear skirts 238 also extend laterally to connect to respective panel sides 242 that are positioned on an underside 246 of the vessel 104. The panel sides 242 extend generally longitudinally between the rear bottom cross-member 186 and an angled shield 250 disposed on the underside 246 of the vessel 104. Ladder mount brackets 254 are provided at corresponding locations on the rear bottom cross-member 186 and the rear upper cross-member 182 of the frame 108 for attaching a ladder (not shown) to the rear end 116. The rear bottom cross-member 186 is angled or sloped as it extends from the respective rear vertical members 150, 154 toward a central region 258, which is a relatively thin section of the rear bottom cross-member 186. To that end, a gap or opening 262 is formed between the rear dished end 230 of the vessel 104 and the central region 258 of the rear bottom cross-member 186, as illustrated in FIGS. 1 and 2. In addition, the gap is 262 extends laterally between the rear skirts 238. A pair of rear support blocks 266 extend downwardly from the rear bottom cross-member 186 to further support the frame 108 when mounted on a vehicle, a rail car, or another tank container.

With reference to FIG. 2, the tank container 100 is provided with connection lugs 270 for grounding the tank container 100 to prevent electrical damage. In the illustrated embodiment, the lugs 270 include two off-brass connection lugs on the rear end 116 of the frame 108. Further, a thermometer 272 is provided on the rear dished end 230 with a dual scale (Celsius and Fahrenheit), in the form of a gas filled capillary type thermometer with shock resistant glass. A contact probe (not shown) of the thermometer 272 is secured to the rear dished end 230 at a location corresponding with a 19% fill level, although other configurations are possible. On the whole, the tank container 100 and all appurtenances thereof are designed for a minimum design operating temperature of about −40 degrees C. (−40 degrees F.), which represents the low limit of the metallurgical design temperature for the vessel 104. The high limit of the metallurgical design temperature for the vessel 104 is about 150 degrees C. (about 302 degrees F.).

Turning briefly to FIG. 3, the front end 112 of the vessel 104 includes a front dished end 274 that is connected to the frame 108. In the illustrated embodiment, the front dished end 274 is connected to the front vertical members 158, 162 by side reinforcing ends or members 276, 277, respectively, which have a thickness that can vary based on wall thickness of the shell 214 and the position of vessel 104 relative to the frame 108, e.g., thinner side reinforcing ends 276, 277 accommodate the vessel 104 being offset toward the front end 112 of the frame 108. Further, the front dished end 274 is attached to the front upper cross-member 190 by a front reinforcing flange 278 extending therebetween. That is, the vessel 104 is attached to the front upper cross-member 190 of the frame 108 by the front reinforcing flange 278, which may be attached by welding, fastening, or the like. Further, a front skirt 280 is provided between the front dished end 274 of the vessel 104 and the front bottom cross-member 194. The front reinforcing flange 278, the front skirt 280, and side reinforcing ends 276, 277 comprise a front ring mounting assembly 281 that secures the front dished end 274 of the vessel 104 to the frame 108 at the front end 112. The front bottom cross-member 194 is angled or sloped as it extends from the front vertical members 158, 162 to a lowest point that is intersected the longitudinal axis 136. A pair of front support blocks 282 extend downwardly from the front bottom cross-member 194 to further support the frame 108 when mounted on a vehicle, rail car, or another tank container. In this particular embodiment, the frame 108 is constructed of steel or steel alloys, such as, e.g., S355J2, SJ275J0, or equivalents. In addition, the corners 198 are constructed of metals or metal alloys, such that the corners 198 are provided to be in compliance with ISO Standard 1161. Further, the rear and front dished ends 230, 274 are insulated with pre-molded polyurethane foam panels, although other configurations are possible.

Figure 4:
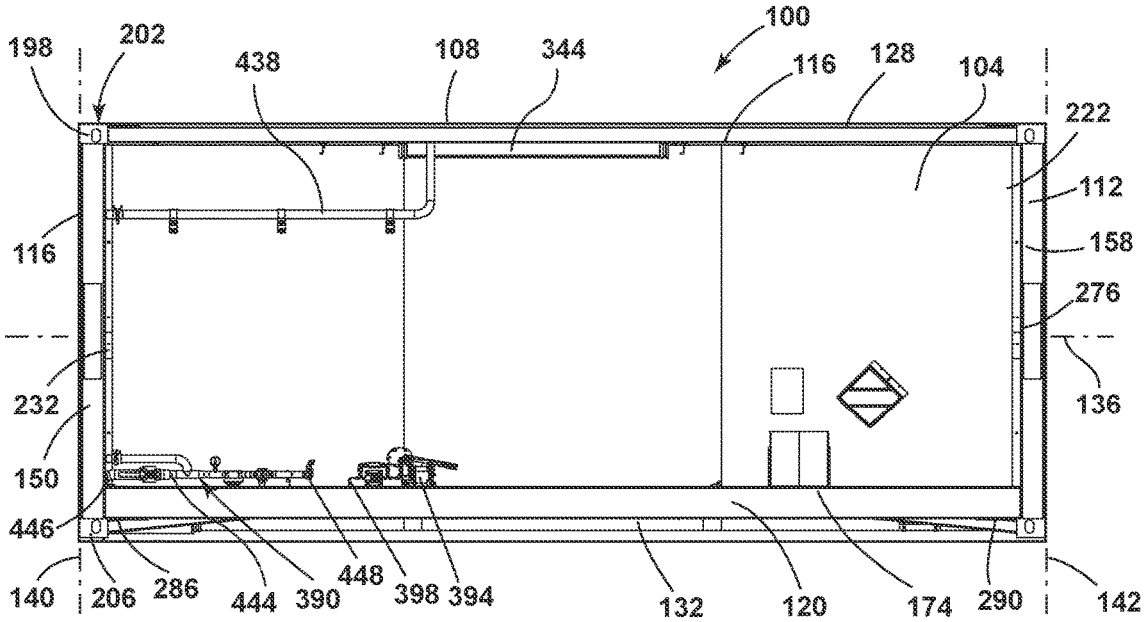
FIG. 4 is a right side elevational view of the tank container of FIG. 1.

With reference to FIGS. 4-6, the frame 108 further includes a set of rear braces 286 and a set of front braces 290 disposed at the bottom end 132. The rear braces 286 extend at an angle between the rear bottom cross-member 186 and the respective lower side rails 174,178 In a similar fashion, the set of front braces 290 extend at an angle between the front bottom cross-member 194 and the respective lower side rails 174, 178. In particular, the set of rear braces 286 connect to the rear support blocks 266, and the set of front braces 290 connect to the front support blocks 282. Further, as illustrated in FIG. 7, a casing 292 is attached to shell 214 at the underside 246 of the vessel 104 and positioned within the spacing 226 formed between the cladding panels 222 and the shell 214. In some embodiments, the casing 292 collects moisture, e.g., condensation, from the shell 214 for removal through a drain line 294 near the rear end 116 of the tank container 100.

Referring back to FIGS. 1-3, the rear dished end 230 and the front dished end 274 of the vessel 104 are connected by the shell 214, and each of the dished ends 230, 274 is made of stainless steel material, such as, e.g., 316L, in compliance with ASTM 216, or SANS 50028-7 Type 1.4402 or Type 1.4404, or equivalents. In some embodiments, the dished ends 230, 274 have a surface finish that is polished smooth to have an arithmetic average of roughness (Ra) measured in accordance with ASME B46.1, although other surface finished are contemplated. Further, the dished ends 230, 274 are configured to have a wall thickness of at least about 4.3 mm (about 0.17 inch) and to accommodate a corrosion allowance of about 0.2 mm (about 0.0079 inch). The dished ends 230, 274 are constructed to be resilient and durable, such that the dished ends 230, 274 have a joint coefficient of 0.85 measured by non-destructive testing methods in accordance with ASME VIII.

In general, the vessel 104 is designed for an operating temperature of about 150 degrees C. (302 degrees F.) and a maximum allowable working pressure of about 2.67 bar (about 38.7 psi). In one embodiment, the tank container 100 has a length of about 6.1 m (about 20 ft) as measured in the longitudinal direction, a width of about 2.4 m (about 8 ft) as measured in the lateral direction, and a height of about 2.6 m (about 8.5 ft) as measured in the vertical direction. However, it will be understood that the tank container 100 of the present disclosure shall not be limited to the foregoing dimensions and that embodiments of tank containers having different dimensions is within the scope of this disclosure. Further, the tank container 100 is configured for a maximum gross weight capacity of about 30,500 kg (about 67,000 lbs.) and a tare weight of about 3,200 kg (about 7,100 lbs.). However, it also will be understood that the tank container 100 of the present disclosure shall not be limited to the foregoing weights/capacities and that embodiments of tank containers having different weights/capacities are within the scope of this disclosure.

Referring back to FIGS. 1-3, a heating system 300 is provided on the tank container 100. The heating system 300 can be operated with both steam and glycol mediums depending upon when the heating system 300 is operated, i.e., while in transit or while stationary. To that end, the heating system 300 includes a steam inlet or supply connection 308 located at the rear end 116 of the tank container 100. The heating system 300 further includes a bottom discharge valve steam supply 314 located adjacent the steam supply 308 at the rear end 116 of the tank container 100. Further, a steam trap and a ball valve are provided in connection with a steam return line 322 that is in fluid communication with a common outlet or return connection 324 that is located at the front end 112 of the tank container 100. The heating system 300 also includes a glycol inlet 328 at the front end 112 of the tank container 100. Additionally, the common outlet connection 324 is coupled to a bypass 332 in the form of a ball valve that is in communication with a glycol line 334. Accordingly, the bypass 332 is configured for isolating the portion of the heating system 300 that is not in use, i.e., the glycol supply 328 or the steam supply 308 and 314. In the illustrated embodiment, the heating system 300 is configured for use with steam when the tank container 100 is stationary, i.e., not during transit, and for operation with glycol when the tank container 100 is conveyed, i.e., in transit. In operation, the heating system 300 is configured for a saturated steam working pressure of about 10.0 bar (about 145.0 psi and a saturated steam test pressure of about 15.0 bar (about 218 psi).

With reference again to FIG. 1, the tank container 100 includes walkways 336 attached to the frame 108 for providing access to a valve arrangement 340 within a spill box 344 located at the top end 128. In the illustrated embodiment, the walkways 336 include several sections, with longitudinal sections extending the longitudinal direction and lateral sections extending the lateral direction. In particular, the walkways 336 surround the spill box 344 and provide a pathway from the rear end 116 to the spill box 344, although other configurations are possible. The walkways 336 may be attached to the upper side rails 166, 170 of the frame 108 and the to the spill box 344 by fasteners, brackets, welding, or the like, such as by U-shaped or L-shaped brackets extending between sides of or undersides of the walkway 336 and the frame 108, such that the surface of the walkways are flush or even with the top end 128 of the frame 108. In this way, the walkways 336 allow for stacking of tank containers on the top end 128. The walkways 336 may be formed as non-slip, self-draining patterns of a durable material, such as a marine-resistant aluminum, in compliance with ASTM B209 M86 or 5052H32, or equivalents.

Figure 8:
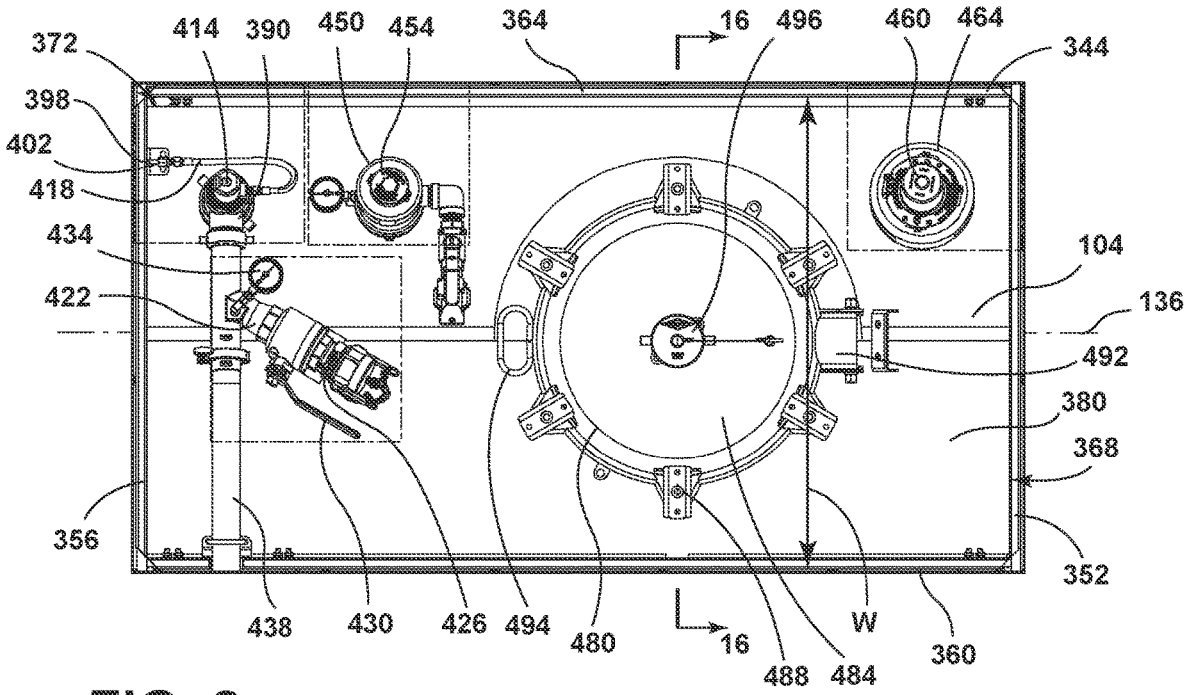
FIG. 8 is a partial, top plan view of a spill box of the tank container of FIG. 1.
Figure 9:
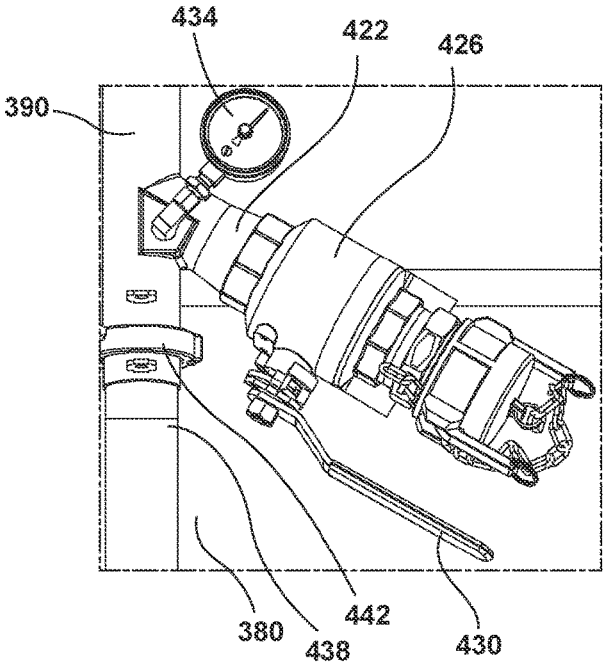
FIG. 9 is a partial, top plan view of a portion of a vapor recovery system of the tank container of FIG. 1.
Figure 10:
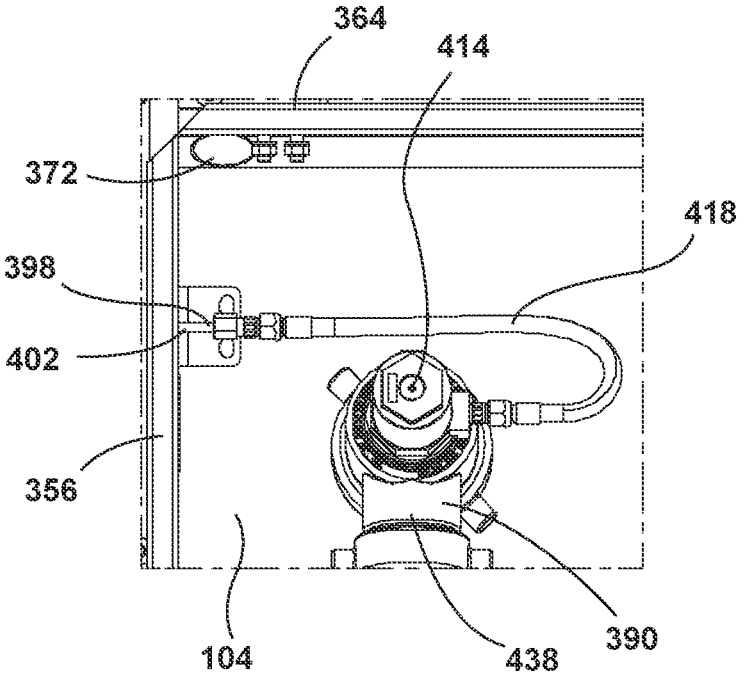
FIG. 10 is a partial, top plan view of another portion of the vapor recovery system of the tank container of FIG. 1.
Figure 11:
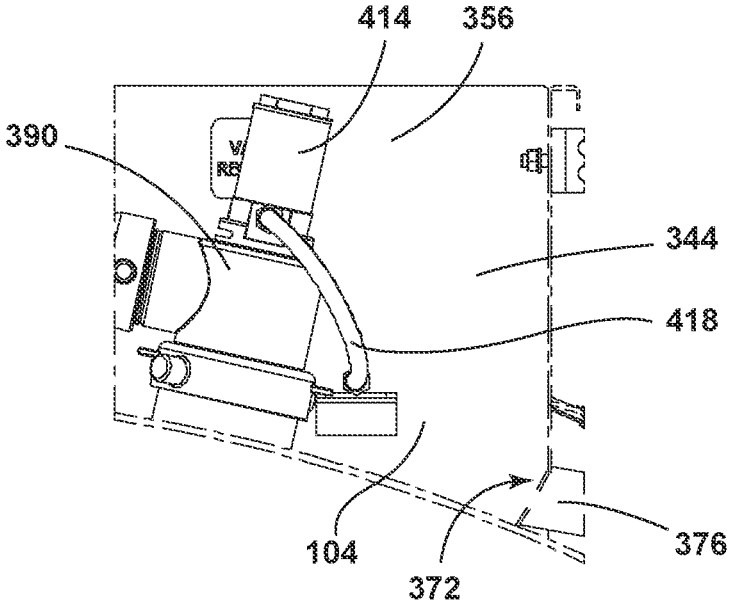
FIG. 11 is a partial, front elevational view of the portion of the vapor recovery system of FIG. 10.

As illustrated in FIGS. 1 and 8, the spill box 344 is positioned on the vessel 104 at the top end 128 of the tank container 100 in the form of a generally rectangular box having opposing front and rear walls 352, 356, opposing curb side and street side walls 360, 364, and an unbounded top opening 368. In some embodiments, a cover (not shown) can be provided to bound or close the top opening 368, such as by extending across the spill box 344 and removably attached to one or more of the walls 352, 356, 360, 364. Additionally, a distance W is defined between the curb side wall 360 and the street side wall 364 of the spill box 344, in the lateral direction. The distance W is substantially uniform across the spill box 344 between the front wall 352 and the rear wall 356, such that the spill box 344 can be divided into equal longitudinal sections, i.e., a street side half and a curb side half, along the longitudinal axis 136, although other configurations are possible.

Referring to FIGS. 7 and 8, the spill box 344 is configured to facilitate drainage of liquids, such as, e.g., precipitation, condensation, or fluids used for cleaning. To that end, the spill box 344 is provided with a drain outlet 372 and a drain line 376 on the street side wall 364 of the spill box 344 and near the rear wall 356. Further, the spill box 344 includes a drain pan 380 that is positioned on the curb side half of the spill box 344 and is disposed at a downward angle between the curb side wall 360 of the spill box 344 and the shell 214 to direct liquids toward the drain 372 and out of the spill box 344. In the illustrated embodiment, drain pan 380 extends approximately half of the distance W and occupies the curb side half of the spill box 344 while each of the aforementioned valves and fittings are arranged on the street side half of the spill box 344. In some embodiments, the drain pan 380 may be disposed at an angle in the longitudinal direction, e.g., sloping downwardly from the front wall 352 to the rear wall 356, to direct liquids toward the drain 372 and out of the spill box 344. Further, the drain line 376 is arranged to extend longitudinally toward the rear end 116 and with a downward slope. As illustrated in FIG. 7, a portion of the drain line 376 extends through the cladding panel 222 and into the spacing 226 before connecting to the drain 372 at the spill box 344. In some embodiments, the drain line 376 is formed of polyvinyl chloride (PVC), or other suitable materials.

With reference to FIGS. 8-11, a vapor recovery system 390 is provided on the tank container 100. The vapor recovery system 390 includes a pump 394 (see FIGS. 4, 6, and 7), in the form of a hydraulic hand-operated pump, that is attached to the lower side rail 174 on the curb side 120 of the frame 108, within the outer periphery of the frame 108 so as not to protrude outwardly thereof. The pump 394 is connected to a pipeline 398 that has a first branch 402 that runs vertically upwards on the vessel 104, within the spacing 226 between the shell 214 and the cladding panels 222, to the spill box 344, as shown in FIGS. 1, 2, and 4. The pipeline 398 further includes a second branch 406 that runs underneath the rear dished end 230 of the vessel 104 and into the gap 262 for operative connection to a valve assembly, as will be described below. Further, the pipeline 398 has a third branch 410 that runs laterally across the rear end 116 to the street side 124 and then longitudinally along the street side 124 to the front end 112 of the frame 108. The pipeline 398 is configured to be serviceable and/or accessible at various locations, e.g., along the second branch 406 at the rear end 116 and along the third branch 410 at the front end 112.

In the illustrated embodiment, the pipeline 398 is provided as a hydraulic pipeline to be compatible with the hydraulic hand-operated pump 394 for remote operation of the vapor recovery system 390. To that end, with reference to FIG. 8 where a top plan view of the spill box 344 is provided, the first branch 402 of the pipeline 398 extends into the spill box 344 and is coupled to a vapor recovery adaptor 414 via a flexible hose 418. The vapor recovery adaptor 414 is configured to be cleaned in-place and is configured for both top and bottom vapor recovery. The vapor recovery adaptor 414 is coupled to the shell 214 of the vessel 104 at the top end 128 and further coupled to a Y-joint 422 that is also connected to an upper vapor return (VR) or air inlet valve 426, which can be operated as a VR valve in some applications and an air inlet valve in other applications. For purposes of clarity, this disclosure will refer to the upper VR valve or air inlet valve 426 as simply the upper VR valve 426. The upper VR valve 426 is a ball valve that includes a locking handle 430 and a gauge 434 and, preferably, the upper VR valve 426 is made of stainless steel or stainless steel alloys. Further, the Y-joint 422 couples the upper VR valve 426 and the vapor recovery adaptor 414 to vapor recovery piping 438. In some embodiments, the vapor recovery system 390 includes a clamp 442, such as, e.g., a 3-off 2" TRI clamp, with TRI ferrules and gaskets (not shown) to facilitate removal and cleaning, and is provided with anti-tampering features, such as, e.g., TIR seal points, in compliance with relevant standards and regulations.

With reference to FIGS. 1, 2, 4, 8, and 9, the vapor recovery piping 438 extends along the vessel 104 to the rear end 116 and down to connect with a manifold 444 on the curb side 120 of the tank container 100. The manifold 444 has various fittings, such as check valves, filters, T-joints, and other suitable fittings to provide proper functionality and operation, and also includes a rear connection 446 and a curb side connection 448. In some embodiments, the rear connection 446 is provided with a quick coupling fitting and a camlock. Further, the curb side connection 448 can be configured as a quick coupling fitting with a ball valve, and the manifold 444 can include a filter, a manometer, and a drainage pipe, among other components. Accordingly, the vapor recovery system 390 is configured to be accessible at the top end 128, at the rear end 116, and on the curb side 120 of the tank container 100, while also being operated remotely, i.e., at a distance from the upper VR valve 426 and/or the rear end 116 of the tank container 100, by actuation of the pump 394 at the bottom end 132 and curb side 120 of the tank container 100.

Figure 12:
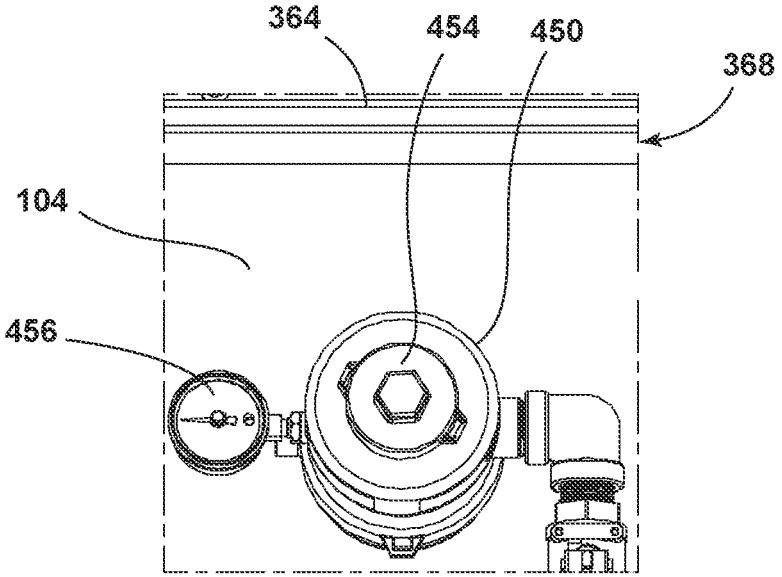
FIG. 12 is a partial, top plan view of a portion of an air inlet assembly of the tank container of FIG. 1.
Figure 13:
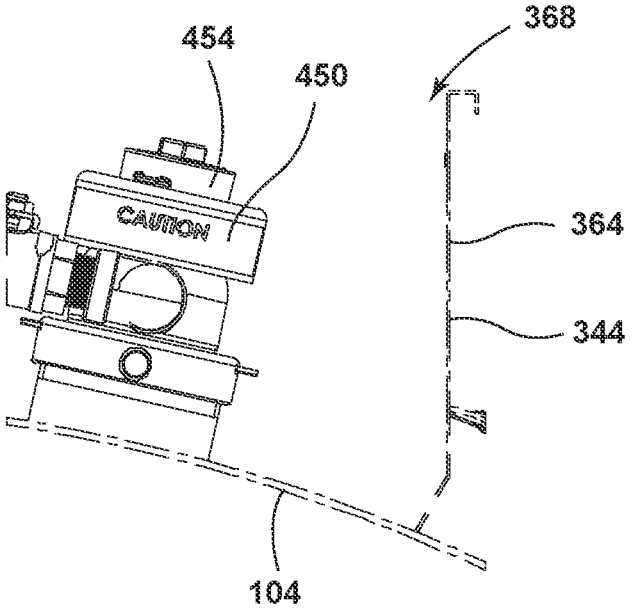
FIG. 13 is a partial, front elevational view of the portion of the air inlet assembly of FIG. 12.

Turning to FIGS. 8 and 12-13, an air inlet assembly 450, which is also known in the tank container industry as a vacuum breaker assembly, is provided in the spill box 344 at the top end 128 of the vessel 104 and proximate the street side wall 364 of the spill box 344. In the illustrated embodiment, the air inlet assembly 450 includes an air inlet valve 454 in the form of a weld-in nozzle configuration with NPT threading, although other configurations are possible. In some embodiments, the air inlet valve 454 is a 4 inch valve provided with several accessories for proper operation, such as an elbow ball valve with male and female couplings, as well as a manometer 456.

Figure 14:
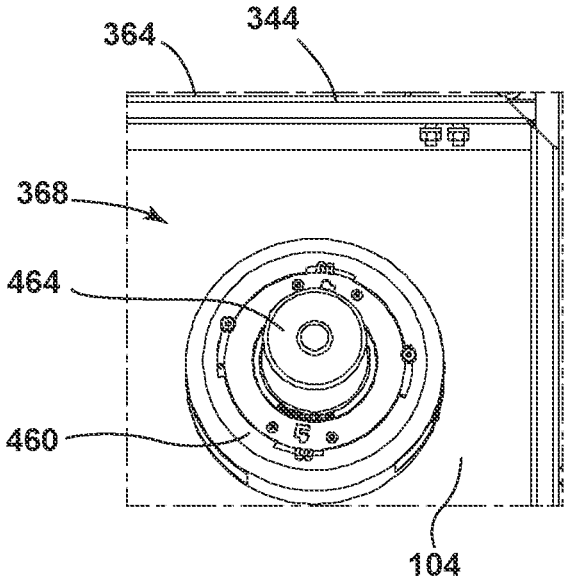
FIG. 14 is a partial, top plan view of a portion of a relief valve assembly of the tank container of FIG. 1.
Figure 15:
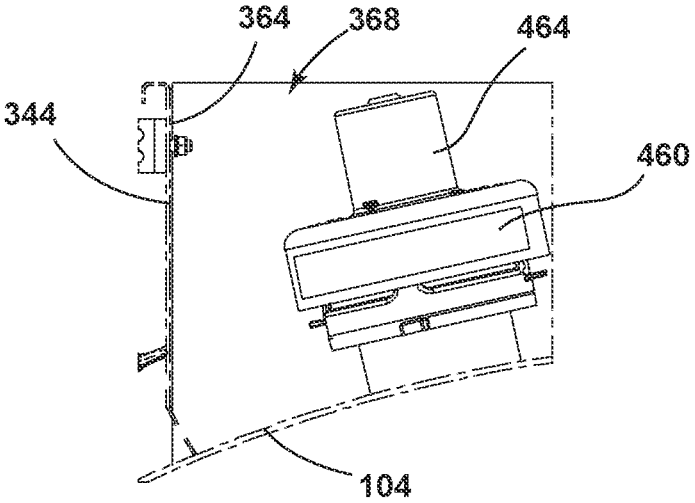
FIG. 15 is a partial, rear elevational view of the portion of the relief valve assembly of FIG. 14.

With reference to FIGS. 8 and 14-15, a safety relief valve assembly 460 is provided in the spill box 344 at the top end 128 of the vessel 104. In the illustrated embodiment, the safety relief valve assembly 460 includes a safety relief valve 464 in the form of a weld-in nozzle configuration with NPT thread, although other configurations are possible. In particular, the safety relief valve 464 is configured for operation with a set pressure of about 3.33 bar (about 48 psi), although other configurations are possible. In some embodiments, the safety relief valve 464 is a 4" pressure only, high flow relief valve with a minimum flow rate of about 2.8761 $Nm^3/s$, although other configurations are possible.

Figure 16:
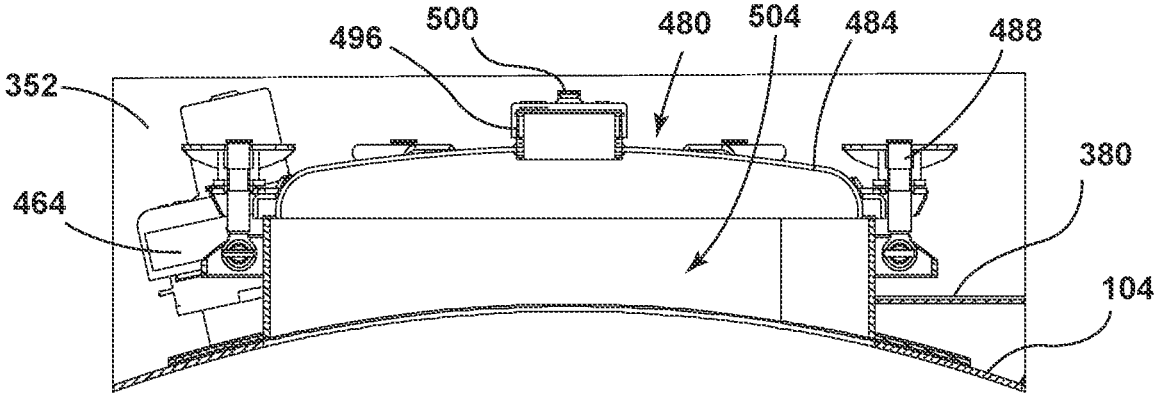
FIG. 16 is a cross-sectional view of a lid of the tank container taken along lines 16-16 of FIG. 6.

With reference to FIGS. 8 and 16, a lid assembly 480 is provided in the spill box 344 at the top end 128 of the vessel 104. The lid assembly 480 includes a lid 484 extending from the vessel 104 having latches 488 radially spaced about the lid 484 and a hinge 492 that allows for movement, e.g., rotation, of the lid 484 from an open configuration to a closed configuration. In the illustrated embodiment, the lid 484 includes a handle 494 (see FIG. 8) located diametrically opposite the hinge 492, and six latches 488 are provided on the lid 484, although greater or fewer latches 488 may be provided without departing from the scope of this disclosure. Further, the hinge 492 may be provided with a biasing mechanism (not shown), such as, e.g., a coil spring, to assist with movement of the lid 484 between the open and closed configurations. In addition, the lid 484 has a nozzle 496 with a cap 500 for cleaning. In some embodiments, the nozzle 496 is a 76.2 mm (3 inch) nozzle located centrally on the lid 484, but other configurations are possible. An access hole 504 is covered by the lid 484 when in the closed configuration and accessible when the lid 484 is moved to the open configuration. In some embodiments, the lid 484 has a diameter of about 506 mm (about 20 inch) and made of stainless steel or stainless steel alloys, such as, e.g., 316. The lid assembly 480 is provided with a gasket (not shown), such as. e.g., a gasket made of chlorosulfonated polyethylene synthetic rubber (CSM) or equivalents.

Figure 17:
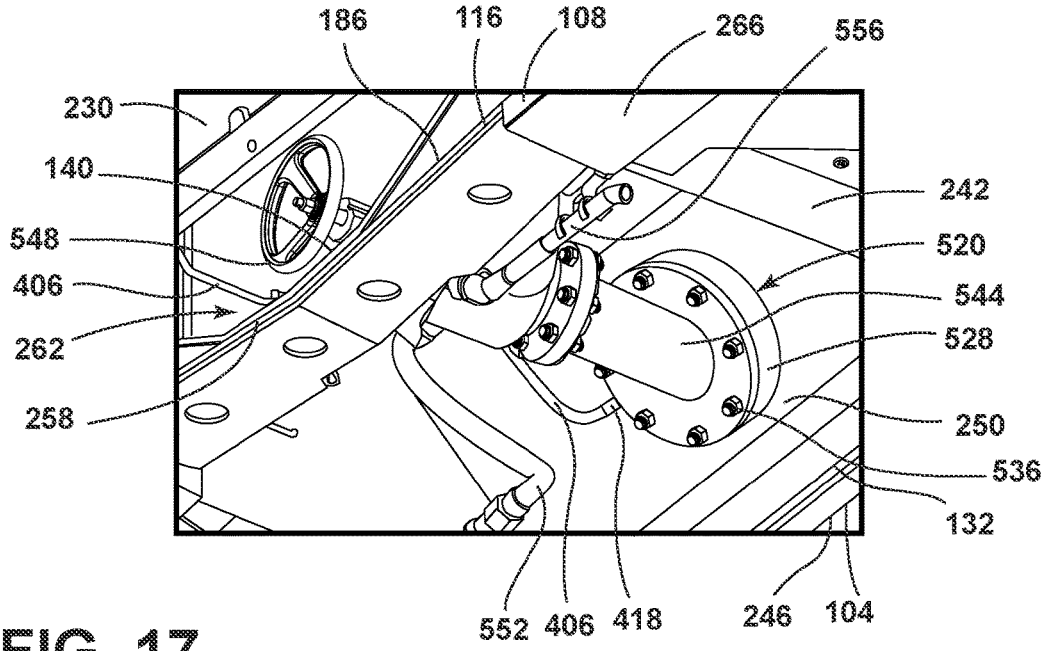
FIG. 17 is a partial, perspective view of a bottom and left side of the tank container of FIG. 1.
Figure 18:
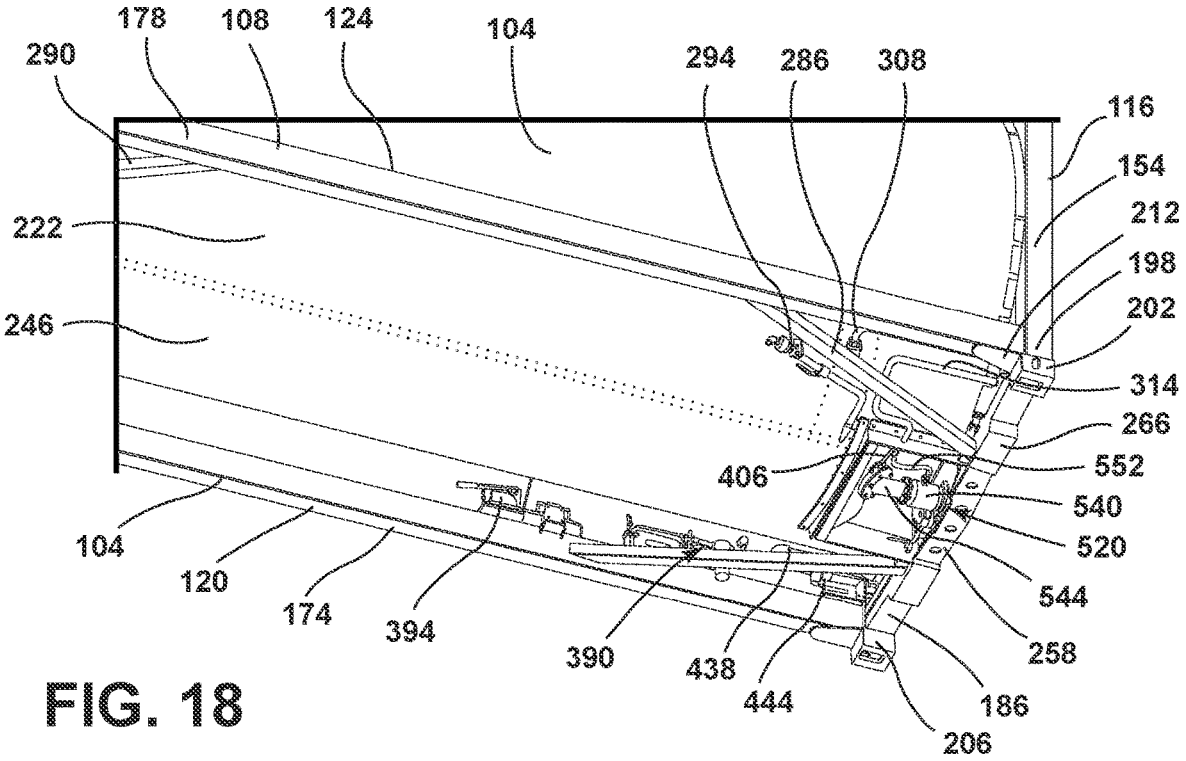
FIG. 18 is a partial, perspective view of a bottom and rear side of the tank container.

Referring to FIGS. 1, 2, 6, 7, 17, and 18, a bottom discharge assembly 520 is provided in the gap 262 between the rear skirts 238 and adjacent the central region 258 of the rear bottom cross-member 186. As shown in FIG. 7, the bottom discharge assembly 520 includes an internal bottom valve or sump 524 attached to the underside 246 of the vessel 104. The internal bottom valve 524 includes a mounting flange 528 and an internal top hat assembly (not shown) that is configured to be in fluid communication with the internal volume 218 of the vessel 104. To that end, the internal bottom valve 524 is located in the knuckle area of the dished end 230 on the underside 246 of the vessel 104. The mounting flange 528 is welded to the rear dished end 230 and located in the gap 262 formed below the rear dished end 230. The internal bottom valve 524 is attached to the mounting flange 528 and thereby to the vessel 104 by fasteners 536, e.g., bolts, (see FIG. 17) threaded through the mounting flange 528, although other configurations are possible. Further, a discharge valve 540 is connected to the internal bottom valve 524 and the vessel 104 by an adaptor 544, as shown in FIGS. 6 and 17-18. With reference to FIGS. 1-6, the vessel 104 is arranged within the frame 108 to also accommodate the bottom discharge assembly 520 within the frame 108. To that end, the vessel 104 is offset longitudinally toward the front end 112 and, in particular, the front dished end 274 is located a shorter front distance from the front end plane 142 than a rear distance between the rear dished end 230 and the rear plane 140. Accordingly, the front and rear ring mounting assemblies 281, 239 are configured to accommodate the vessel 104 being offset longitudinally toward the front end 112. In this way, the tank container 100 is configured to allow ample longitudinal space for housing the bottom discharge assembly 520 extending from the rear dished end 230 toward the rear end 116 within the frame 108.

In some embodiments, the rear distance between the rear dished end 230 of the vessel 104 and the rear end 116 and/or rear plane 140 on the frame 108 can be between about 100 mm and about 500 mm and, preferably, the rear distance is between about 150 mm and about 400 mm. More preferably, the rear distance is between about 200 mm and about 300 mm. In one embodiment, the rear distance is about 220 mm between the rear dished end 230 of the vessel 104 and the rear end 116 of the frame 108.

In some embodiments, the front distance between the front dished end 274 of the vessel 104 and the front end 112 and/or front plane 142 on the frame 108 can be between about 5 mm and about 75 mm and, preferably, the front distance is between about 10 mm and about 50 mm. More preferably, the front distance is between about 15 mm and about 40 mm. In one embodiment, the front distance is about 30 mm between the front dished end 274 of the vessel 104 and the front end 112 of the frame 108. Accordingly, the front distance is between about 5% and about 50% of the rear distance and, preferably, the front distance is between about 10% and about 25% of the rear distance. In one embodiment, the front distance is about 12% of the rear distance.

Additionally, the vessel 104 is arranged with in the frame 108 between the top end 128 and the bottom end 132. In some embodiments, the vessel 104 is offset toward the top end 128 of the frame 108 to accommodate the bottom discharge assembly 520 within the frame 108, such that the vessel 104 is positioned a top distance that is shorter than a bottom distance between the vessel 104 and the bottom end 132 of the frame 108. In other embodiments, the vessel 104 is positioned offset toward the bottom end 132 of the frame 108 to accommodate the spill box 344 within the frame 108. It is contemplated that the top distance and the bottom distance each can be between about 10 mm to about 500 mm. In one embodiment, the top distance is between about 200 mm and about 300 mm, and the bottom distance is between about 100 mm and about 200 mm.

In the illustrated embodiment, the discharge valve 540 includes a discharge outlet 546 that curves laterally and rearwardly adjacent a hand wheel 548 that is provided for manually opening and closing the discharge valve 540. The adaptor 544 extends substantially linearly in the longitudinal direction from the internal bottom valve 524 to the discharge valve 540, although other configurations are possible. Further, the top hat assembly (not shown) of the internal bottom valve 524 is configured to be hydraulically operated by the hydraulic pump 394 via connection to the second branch 406 of the pipeline 398. The discharge valve 540 has a steam inlet connection 550 that is operably connected to the heating system 300 through a heating hose 552 for steam heating of the discharge valve 540, and the discharge valve 540 also includes a drain line 556 to direct moisture, e.g., condensation, away from the bottom discharge valve assembly 520.

When the tank container 100 is in a filled state, the internal volume of the vessel 104 is at least 80% occupied by liquid and/or contents while the remaining volume is occupied by gas, e.g., vapors, inert gases, compressed air, etc. In some instances, chemical reactions, ambient temperatures, and/or agitation due to motion related to transportation can increase an internal pressure of the internal volume 218 of the vessel 104. Thus, the safety relief valve assembly 460 operates to maintain the internal pressure of the internal volume 218 within a desired pressure range. Further, when liquid in the internal volume 218 is discharged from the vessel 104 to an external system or source, the internal pressure within the internal volume 218 may be increased by actuating the hydraulic hand pump 394 to facilitate evacuation of the liquid and/or gas from the vessel 104. The vessel 104 is preferably evacuated down to an empty state at which 20% or less of the internal volume 218 is occupied by liquid and/or gas. The tank container 100 allows for remote operation of the vapor recovery system 390 and the internal bottom valve 524 of the discharge assembly 520 from the hand pump 394. To that end, the pipeline 398 is operably connected to the internal bottom valve 524 and vapor recovery adaptor 414, while the vapor recovery piping 438 is accessible from the top end at the upper VR valve 426 and also from ground level at the rear connection 446 at the rear end 116 and the curb side connection 448 near the manifold 444. For example, instead of climbing to the top end 128 of the tank container 100 to open and close the upper VR valve 426 before and after performing a liquid discharge operation, an operator can connect and disconnect an external air line (not shown) to the curb side connection 448. Accordingly, the tank container 100 allows users to perform various operations, e.g., vapor recovery and liquid discharge/transfer, from a substantially centralized location at ground level near the hand pump 394, which reduces the time and number of operators required to operate the tank container 100.

Figure 19:
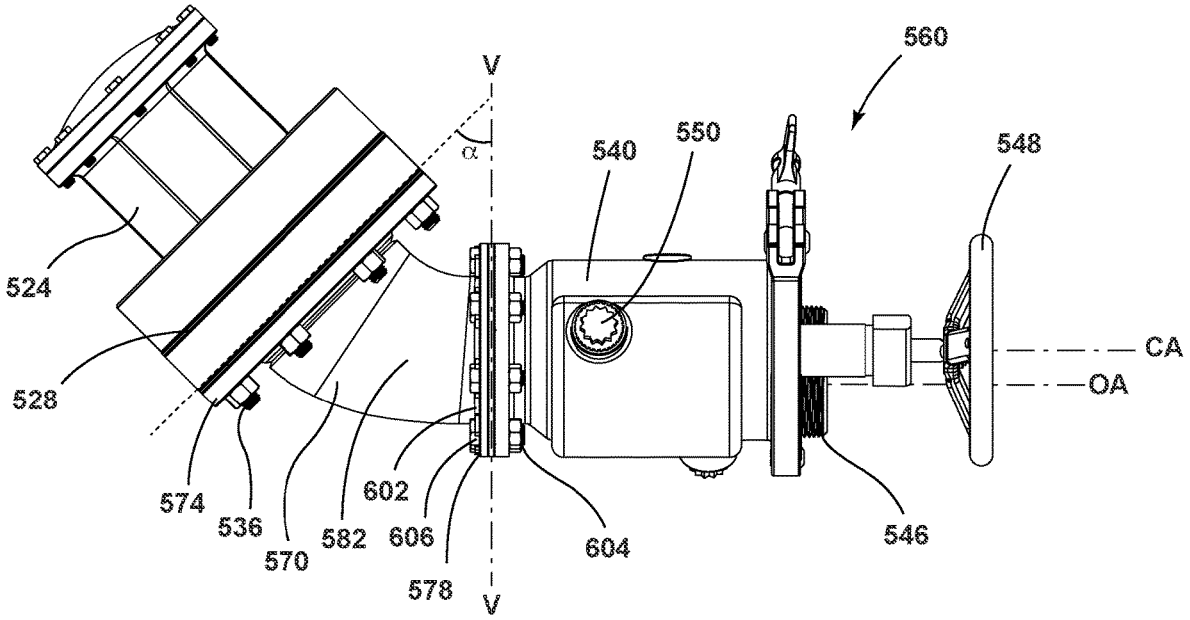
FIG. 19 is a left side elevational view of an embodiment of a bottom discharge valve assembly.
Figure 20:
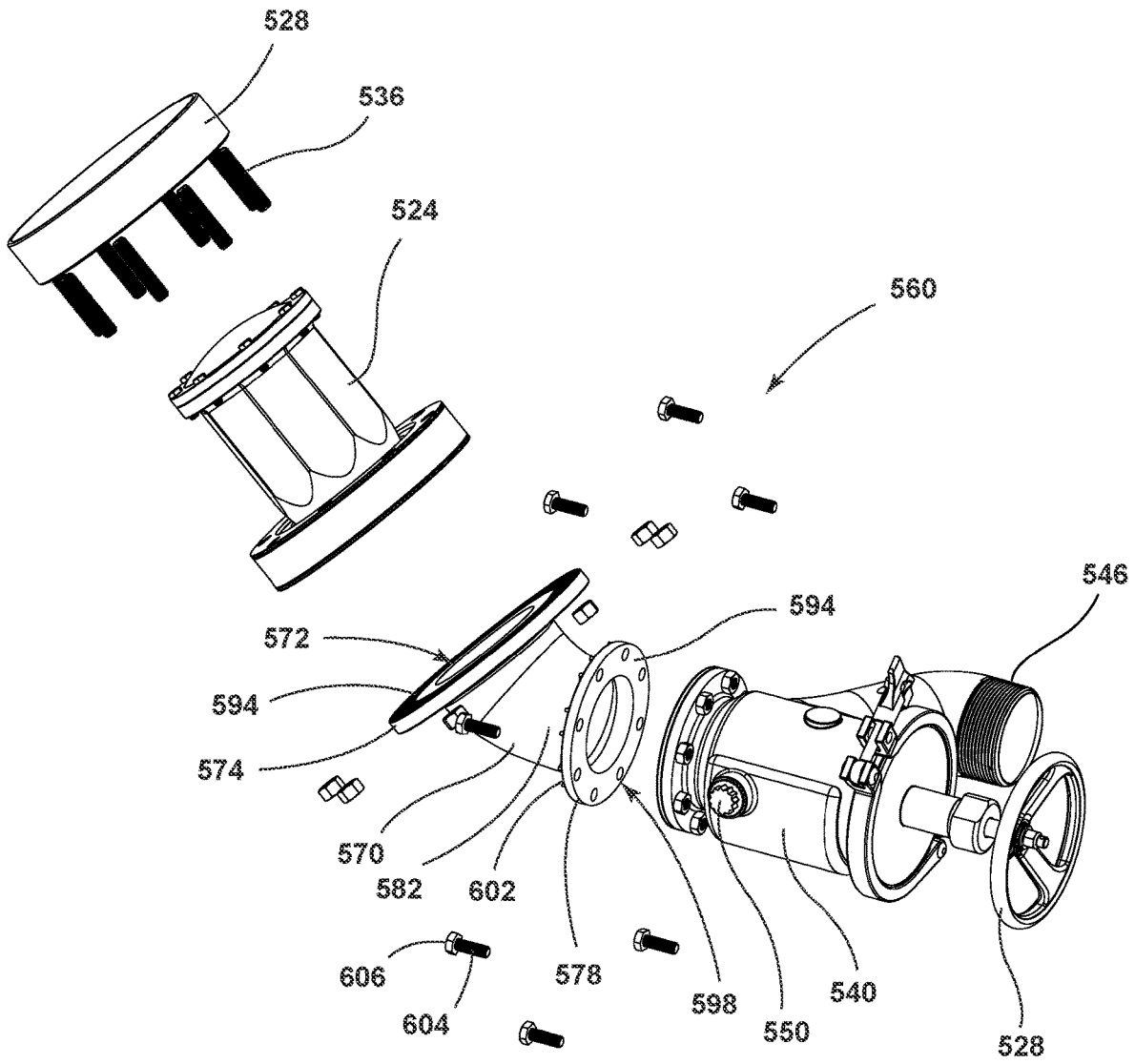
FIG. 20 is an exploded, perspective view of a left and rear side of the bottom discharge valve assembly of FIG. 19.
Figure 21:
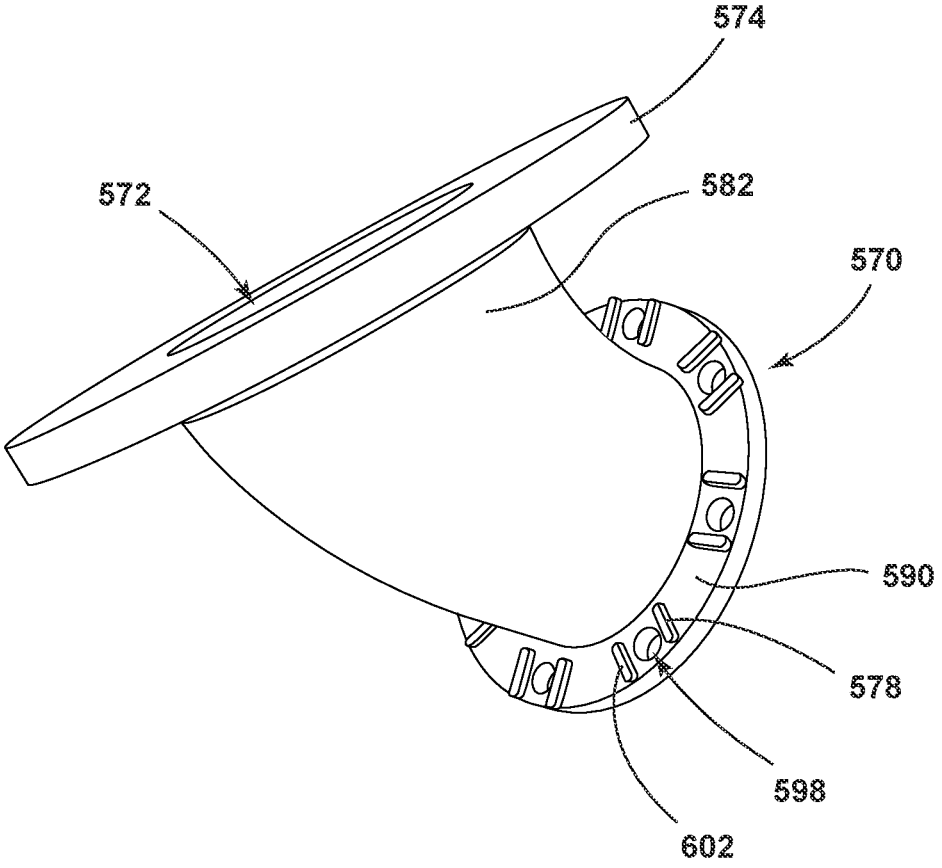
FIG. 21 is a perspective view of a left and front side of an adaptor of the bottom discharge valve assembly of FIG. 20.

FIGS. 19-21 depict another embodiment of a bottom discharge assembly 560 that is configured to be used with the tank container 100 of FIG. 1. The bottom discharge assembly 560 is similar to the bottom discharge assembly 520 of FIG. 18 and, thus, like reference numerals will be used to indicate like components. As illustrated in FIGS. 19 and 20, the bottom discharge valve assembly 560 includes the internal bottom valve 524 coupled to the discharge valve 540 by an adaptor 570. The adaptor 570 has an interior 572 that extends from an inner flange 574 to an outer flange 578 for discharging the liquid from the internal volume 218 of the vessel 104. Accordingly, the inner flange 574 is attached to the vessel 104, and preferably to the mounting flange 528. Further, the outer flange 578 is attached to the discharge valve 540. As illustrated in FIG. 19, the outer flange 578 defines a vertical axis V and the adaptor 570 is provided with a curved body 582 between the inner flange 574 and the outer flange 578. It will be appreciated that the vessel 104 can be offset longitudinally toward the front end 112 to accommodate the bottom discharge assembly 560 extending from the rear dished end 230 at the rear end 116 within the frame 108. In the illustrated embodiment, the inner flange 574 is disposed at about a 45 deg angle relative to the vertical axis V of the outer flange 578. To that end, the curved body 582 bends, i.e., curves convexly downwardly and outwardly, to connect to the outer flange 578. Further, the discharge valve 540 defines a central axis CA that extends centrally through the hand wheel 548, and the discharge outlet 546 defines an outlet axis OA that is parallel with and offset downwardly from the central axis CA of the discharge valve 540. To that end, the discharge outlet 546 extends downwardly from the discharge valve 540 below the central axis CA. When viewed from a rear elevational view, the outlet axis OA of the discharge outlet 546 is radially offset about 5 degrees from a horizontal plane defined by the central axis CA.

When the bottom discharge assembly 560 is mounted to the tank container 100, the shape and size of the adaptor 570 allows the discharge valve 540 to be positioned entirely within the frame 108 and offset inwardly from the rear plane 140 at the rear end 116 of the tank container 100. In some embodiments, the adaptor 570 is provided to be about 203 mm (8 inches) long in the longitudinal direction, i.e., perpendicular to the V axis, and about 152 mm (6 inches) tall in the vertical direction, i.e., parallel with the V axis. Accordingly, the discharge valve 540 is spaced a sufficient distance, e.g., between about one (1) inch and about ten (10) inches, from the rear plane 140 of the frame 108 to be in compliance with pertinent regulations or standards, e.g., USDOT regulations. This inward position of the outer flange 578 also allows for a sufficient distance, e.g., at least six (6) inches, from a bumper (not shown) of a truck or vehicle when the container 100 is mounted on a flatbed of the truck, in compliance with USDOT regulations, e.g., 49 C.F.R. § 180.405(1). Accordingly, the outer flange 578 of the adaptor 570 is positioned within the frame 108 at a position for connection with the discharge valve 540 to help minimize damage to the discharge valve 540, the discharge outlet 546, and the hand wheel 548, such as when mounted on a vehicle, e.g., a flatbed truck, for transport.

In the illustrated embodiment, the adaptor 570 is a curved pipe section through which fluid/contents stored within the internal volume 218 of the vessel 104 can be discharged. As illustrated in FIG. 19, a curved body 582 of the adaptor 570 extends both downwardly and longitudinally rearwardly from the internal bottom valve 524 and/or the vessel 104. In this way, the adaptor 570 is configured to position the discharge valve 540 at least partially below the internal bottom valve 524, which allows gravity to assist during discharge of liquid from the tank container 100. In addition, when the adaptor 570 is installed as part of the bottom discharge assembly 560, the inner flange 574 is configured to be elevated vertically above the outer flange 578 to provide a downward-sloping elevation difference, unlike conventional adaptors or discharge assemblies that have an opposite or inverted elevation difference. Accordingly, the uppermost point of the interior 572 at the inner flange 574 of the adaptor 570 is elevated above the uppermost point of the interior 572 at the outer flange 578.

Further, the adaptor 570 is configured to allow ample room for access and connection to the vessel 104 while being spaced from the bottom end 132 of the frame 108, thereby providing clearance with the ground or when stacked. In addition, the curved body 582 narrows from the inner flange 574 toward the outer flange 578, such that the interior 572 also narrows in diameter, e.g., from about 101 mm (4 inches) to about 76 mm (3 inches), between the inner flange 574 and the outer flange 578, thereby increasing a velocity of the liquid and/or contents discharged from the vessel 104. This is contrary to conventional adaptors and/or discharge assemblies that may expand or increase in diameter from the inner flange to the outer flange. It will also be appreciated that the curved body 582 of the adaptor 570 is configured to avoid forming sharp edges within the interior 572, unlike conventional adaptors. In this way, the adaptor 570 may reduce the risk of trapping or collecting liquid, particles, debris, and any other undesirable buildup of matter inside the adaptor 570. Further, a mating surface 586 of the inner flange 574 is provided with serration in compliance with ASME B16.5 for engagement with the internal bottom valve 524. The adaptor 570 may be made of stainless steel or stainless steel alloys, e.g., CF8M austenitic stainless steel, although other materials are contemplated.

Referring to FIGS. 19, 20, and 21 the inner flange 574 is coupled to the internal bottom valve 524 and the outer flange 578 is coupled to the discharge valve 540. In the illustrated embodiment, the outer flange 578 has a plurality of apertures 598 spaced radially and a plurality of tabs 602 disposed on a back side 590 that is opposite a mating surface 594 configured for engagement with the discharge valve 540. In the illustrated embodiment, the tabs 602 are provided in pairs on opposing sides of each aperture 598 on the outer flange 578 where a fastener 604, e.g., a bolt, can be inserted to secure the outer flange 578 to the discharge valve 540. Each fastener 604 includes a head 606, such as a hex head, that is configured to be captured between the paired tabs 602 when the fastener 604 is inserted through the aperture 598 of the outer flange 578. In this way, the tabs 602 are configured receive and capture the head 606 of each of the fasteners 604 to facilitate mounting and assembly of the adaptor 570 to the discharge valve 540 by preventing rotation of the head when a nut at an opposite end of the fastener is tightened. In another embodiment, the direction of the fastener may be reversed so that the bolt may be captured between the tabs 602 to prevent its rotation when the head of the fastener is rotated. Accordingly, assembly and/or disassembly of the bottom discharge assembly 560 can be performed by a single technician using fewer tools, e.g., one wrench, thereby minimizing downtime and labor costs.

Figure 22:
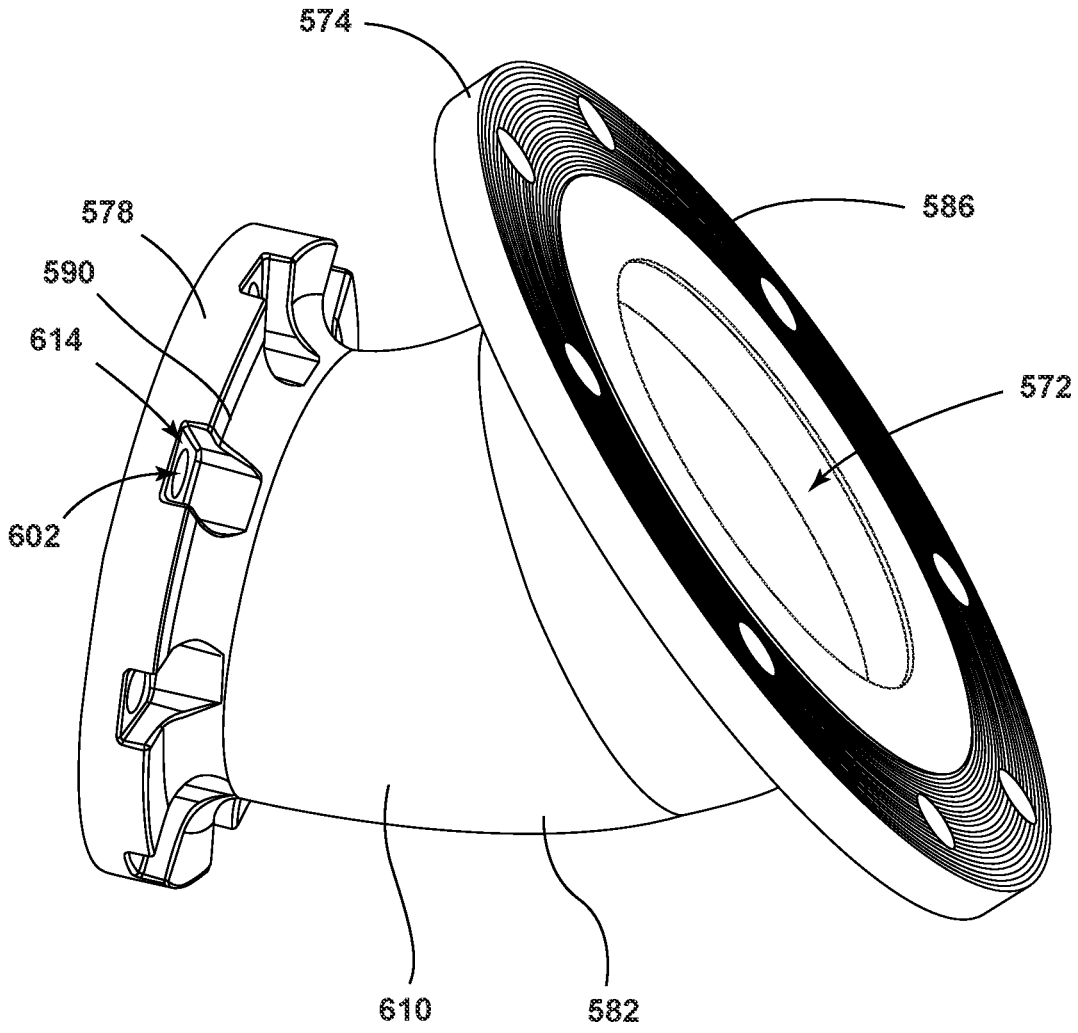
FIG. 22 is a perspective view of a right and rear side of another embodiment of an adaptor.
Figure 23:
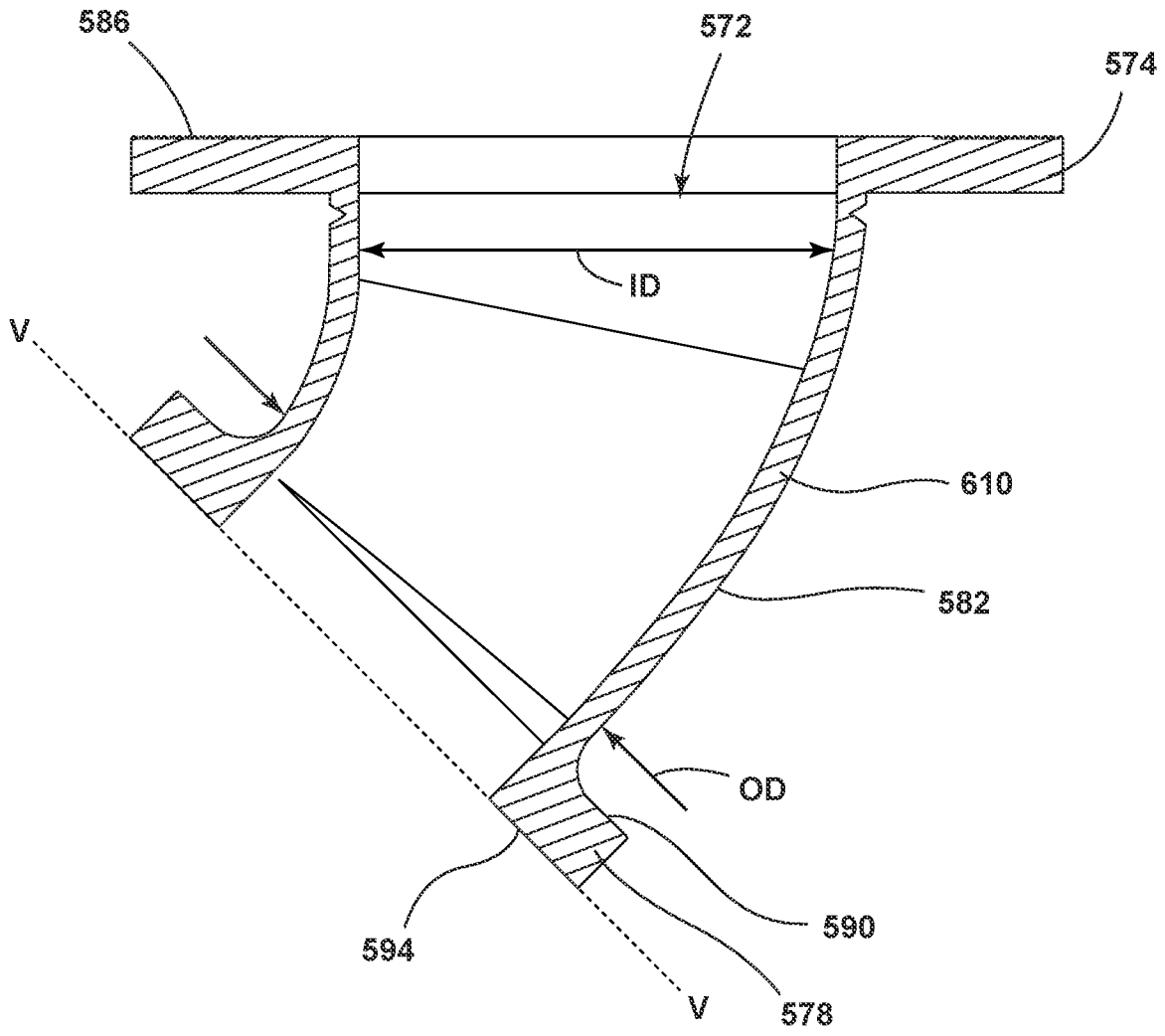
FIG. 23 is a sectional view of the adaptor of FIG. 22.

Referring to FIGS. 22 and 23, another embodiment of an adaptor 610 that is configured for use with the tank container 100 is shown. In the illustrated embodiment, the adaptor 610 includes a plurality of slots 614 formed on the back side 590 of the outer flange 578. The slots 614 are spaced radially about the outer flange 578 and correspond with the apertures 598, such that each aperture 598 is positioned within one of the slots 614. When the adaptor 610 is assembled with the discharge valve 540, the head 606 of the fastener 604 or, alternatively, a bolt, is received within the slot 614 to become captured after the fastener 604 is threaded through the aperture 598. Thus, in this additional way, a single technician can use fewer tools, e.g., one wrench, for assembling and/or disassembling the adaptor 610 and the discharge valve 540, thereby minimizing downtime and labor costs.

Referring to FIG. 23, the curved body 582 of the adaptor 610 is convexly curved between the inner flange 574 and the outer flange 578 along a longer side of the body 582 and concavely curved between the inner flange 574 and the outer flange 578 along a shorter side of the body. Accordingly, when the adaptor 610 is assembled with the discharge valve 540 and the internal bottom valve 524 on the vessel 104 to form the bottom discharge valve assembly 560, the curvature and compact sizing of the adaptor 610 allows for the discharge valve 540 to be positioned within the frame 108 and offset inwardly from the rear plane 140 of the rear end 116. In addition, an inside diameter ID of the interior 572 and an outside diameter OD of the curved body 582 narrow from the inner flange 574 to the outer flange 578. In some embodiments, the ID is about 102 mm (4 inches) proximate the inner flange 574 and about 76 mm (3 inches) proximate the outer flange 578. In this way, the liquid discharged from the internal volume 218 of the vessel 104 travels with increased velocity through the adaptor 610 and out of the discharge valve 540 during operation.

Figure 24:
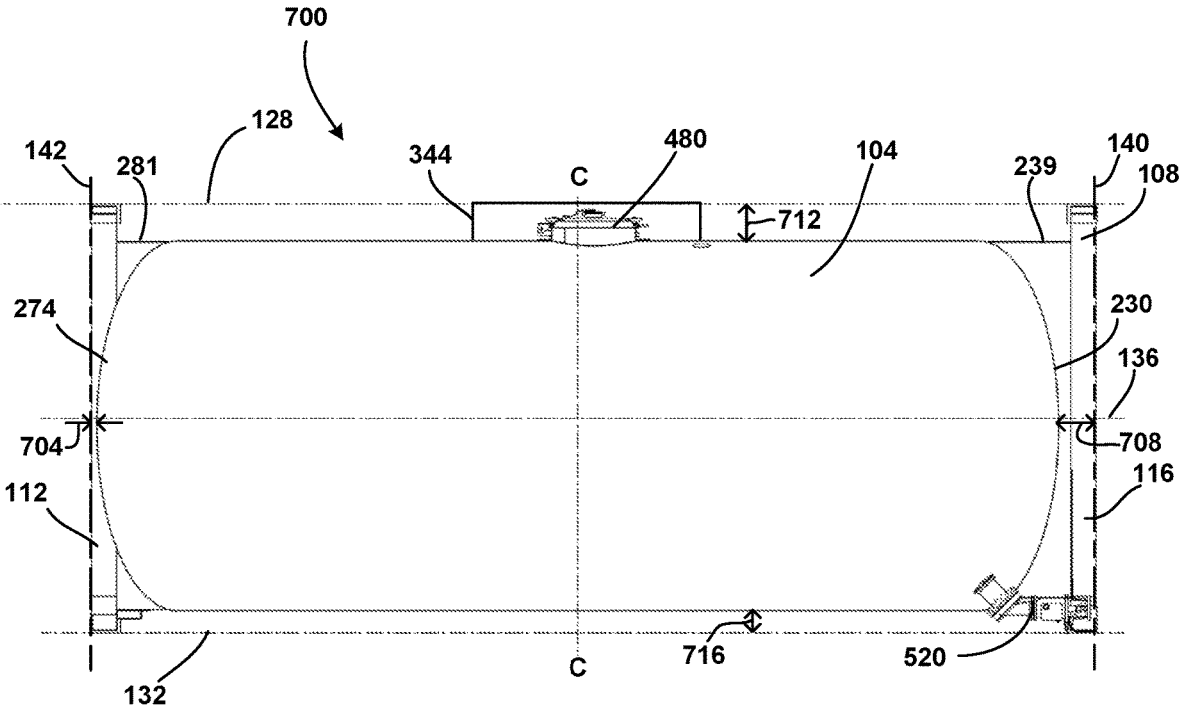
FIG. 24 is a schematic representation of a sectional view of another embodiment of a tank container.

FIG. 24 depicts a schematic representation of another embodiment of a tank container 700. The tank container 700 share similarities with the tank container 100 of FIGS. 1-18 and, thus, like reference numerals will be used to indicate like components. It will be appreciated that the vessel 104 is compatible with the bottom discharge assembly 560 of FIG. 19 and also with the bottom discharge assembly 520 of FIG. 18. Further, it will be appreciated that the top end 128 defines a top plane and the bottom end 132 defines a bottom plane that is parallel with the top plane; accordingly, the top plane is referenced as the top end 128 and the bottom plane 132 is referenced as the bottom end 132, for purposes of clarity. In addition, the vessel 104 is illustrated defining a central axis C that is disposed centrally between the front dished end 274 and the rear dished end 230.

As illustrated in FIG. 24, the vessel 104 is arranged within the frame 108 to accommodate the bottom discharge assembly 520 within the frame 108. To that end, the vessel 104 is offset longitudinally toward the front end 112 and, in particular, the front dished end 274 is located a shorter front distance 704 from the front end plane 142 than a rear distance 708 between the rear dished end 230 and the rear plane 140. Accordingly, the front and rear ring mounting assemblies 281, 239 are configured to accommodate the vessel 104 being offset longitudinally toward the front end 112. In this way, the tank container 100 is configured to allow ample longitudinal space for housing the bottom discharge assembly 520 extending from the rear dished end 230 toward the rear end 116 within the frame 108.

In some embodiments, the rear distance 708 between the rear dished end 230 of the vessel 104 and the rear end 116 and/or rear plane 140 on the frame 108 can be between about 100 mm and about 500 mm and, preferably, the distance 708 is between about 150 mm and about 400 mm. More preferably, the distance 708 is between about 200 mm and about 300 mm. In one embodiment, the rear distance 708 is about 220 mm between the rear dished end 230 of the vessel 104 and the rear end 116 of the frame 108.

In some embodiments, the front distance 704 between the front dished end 274 of the vessel 104 and the front end 112 and/or front plane 142 on the frame 108 can be between about 5 mm and about 75 mm and, preferably, the distance 704 is between about 10 mm and about 50 mm. More preferably, the distance 704 is between about 15 mm and about 40 mm. In one embodiment, the front distance 704 is about 30 mm between the front dished end 274 of the vessel 104 and the front end 112 of the frame 108. Accordingly, the front distance 704 is between about 5% and about 50% of the rear distance 708 and, preferably, the front distance 704 is between about 10% and about 25% of the rear distance 708. In one embodiment, the front distance 704 is about 12% of the rear distance 708.

Additionally, the vessel 104 is arranged with in the frame 108 between the top end 128 and the bottom end 132. In some embodiments, the vessel 104 is offset toward the top end 128 of the frame 108 to accommodate the bottom discharge assembly 520 within the frame 108, such that the vessel 104 is positioned a top distance 712 that is shorter than a bottom distance 716 between the vessel 104 and the bottom end 132 of the frame 108. In the embodiment of FIG. 24, the vessel 104 is positioned offset toward the bottom end 132 of the frame 108 to accommodate the spill box 344 within the frame 108. In some embodiments, the top distance 712 is between about 100 mm and about 500 mm and, preferably the top distance 712 is between about 150 mm and about 400 mm. More preferably, the top distance 712 is between about 200 mm and about 300 mm. In the illustrated embodiment, the top distance 712 is about 220 mm. Further, the bottom distance 716 can be between about 50 mm and about 300 mm and, preferably the bottom distance 716 is between about 75 mm and about 250 mm. In the illustrated embodiment, the bottom distance 716 is about 130 mm. Accordingly, when the vessel 104 is offset vertically toward the top end 128 of the frame 108, as illustrated in FIG. 24, the bottom distance 716 is 60% of the top distance 712.

Although various aspects are herein disclosed in the context of certain preferred embodiments, implementations, and examples, it will be understood by those skilled in the art that the present invention extends beyond the specifically disclosed embodiments to other alternative embodiments and/or uses of the inventive aspects and obvious modifications and equivalents thereof. In addition, while a number of variations of the aspects have been noted, other modifications, which are within their scope, will be readily apparent to those of skill in the art based upon this disclosure. It should be also understood that the scope of this disclosure includes the various combinations or sub-combinations of the specific features and aspects of the embodiments disclosed herein, such that the various features, modes of implementation and operation, and aspects of the disclosed subject matter may be combined with or substituted for one another. Thus, it is intended that the scope of the present invention herein disclosed should not be limited by the particular disclosed embodiments or implementations described above but should be determined only by a fair reading of the claims.

Similarly, this method of disclosure, is not to be interpreted as reflecting an intention that any claim require more features than are expressly recited in that claim. Rather, as the following claims reflect, inventive aspects lie in a combination of fewer than all features of any single foregoing disclosed embodiment. Thus, the claims following the Detailed Description are hereby expressly incorporated into this Detailed Description, with each claim standing on its own as a separate embodiment.

INDUSTRIAL APPLICABILITY

Numerous modifications to the present invention will be apparent to those skilled in the art in view of the foregoing description. Accordingly, this description is to be construed as illustrative only and is presented for the purpose of enabling those skilled in the art to make and use the invention. The exclusive rights to all modifications which come within the scope of the appended claims are reserved.

The invention claimed is:

1. A tank container, comprising:

a frame having a front end opposite a rear end that defines a rear plane;

a vessel extending between the front end and the rear end of the frame; and a discharge valve assembly that is located at the rear end of the frame and coupled to the vessel, the discharge valve assembly further comprising:

an internal bottom valve;

a discharge valve having an outlet; and an adaptor that curves downwardly between the internal bottom valve and the discharge valve, wherein the internal bottom valve is at least partially positioned within an interior volume of the vessel, wherein the adaptor includes an inner flange and an outer flange, the inner flange being disposed at an acute angle relative to the outer flange, and wherein the discharge valve is positioned entirely within the frame and offset at least one inch inward from the rear plane.

2. The tank container of claim 1, wherein the adaptor is configured to position the discharge valve below the internal bottom valve.

3. The tank container of claim 1, wherein the inner flange is disposed at about a 45 degree angle relative to the outer flange.

4. The tank container of claim 3, wherein the adaptor includes a curved body that narrows in diameter between the inner flange and the outer flange.

5. The tank container of claim 4, wherein the outer flange of the adaptor includes a plurality of apertures spaced radially and a plurality of tabs arranged on a first side of the outer flange.

6. The tank container of claim 4, wherein the outer flange of the adaptor includes a plurality of apertures spaced radially and a plurality of slots arranged on a first side of the outer flange.

7. The tank container of claim 5, wherein each of the apertures of the outer flange of the adaptor are configured to receive a fastener therethrough and a head of the fastener is configured to be received between two of the tabs.

8. The tank container of claim 6, wherein each of the apertures of the outer flange of the adaptor are configured to receive a fastener therethrough and a head of the fastener is configured to be received within one of the slots.

9. The tank container of claim 1, wherein the discharge valve is operably connected to a heating system.

10. A tank container, comprising:

a frame having a front end opposite a rear end that defines a rear plane;

a vessel extending between the front end and the rear end of the frame; and a discharge valve assembly that is located at the rear end of the frame and coupled to the vessel, the discharge valve assembly further comprising:

an internal bottom valve;

a discharge valve having an outlet; and an adaptor that curves downwardly between the internal bottom valve and the discharge valve, wherein the internal bottom valve is at least partially positioned within an interior volume of the vessel, wherein the adaptor includes an outer flange having a mating surface that is opposite a back surface, the mating surface being configured to engage the discharge valve, wherein a plurality of tabs are disposed on the back surface of the outer flange, and wherein the discharge valve is positioned entirely within the frame and offset at least one inch inward from the rear plane.

11. The tank container of claim 10, wherein the outer flange includes a plurality of apertures that are spaced radially on the outer flange and extend through the back surface and the mating surface.

12. The tank container of claim 11, wherein the plurality of tabs are spaced radially on the outer flange and provided in pairs on opposing sides of at least one aperture of the plurality of apertures.

13. The tank container of claim 11, wherein at least one aperture of the plurality of apertures is configured to receive a fastener therethrough and a head of the fastener is configured to be received between one pair of the plurality of tabs.

14. The tank container of claim 10, wherein the adaptor includes a curved body that narrows in diameter between an inner flange and the outer flange.

15. The tank container of claim 14, wherein the inner flange is disposed at an acute angle relative to the outer flange.

16. A tank container, comprising:

a frame having a front end opposite a rear end that defines a rear plane;

a vessel extending between the front end and the rear end of the frame; and a discharge valve assembly that is located at the rear end of the frame and coupled to the vessel, the discharge valve assembly further comprising:

an internal bottom valve;

a discharge valve having an outlet; and an adaptor that curves downwardly between the internal bottom valve and the discharge valve, wherein the internal bottom valve is at least partially positioned within an interior volume of the vessel, wherein the adaptor includes an outer flange having a mating surface that is opposite a back surface, the mating surface being configured to engage the discharge valve, wherein a plurality of slots are formed on the back surface of the outer flange, and wherein the discharge valve is positioned entirely within the frame and offset at least one inch inward from the rear plane.

17. The tank container of claim 16, wherein the outer flange includes a plurality of apertures that are spaced radially on the outer flange and extend through the back surface and the mating surface.

18. The tank container of claim 17, wherein the plurality of slots are spaced radially about the outer flange and at least one slot of the plurality of slots corresponds with at least one aperture of the plurality of apertures.

19. The tank container of claim 17, wherein at least one aperture of the plurality of apertures is configured to receive a fastener therethrough and a head of the fastener is configured to be received within one of the slots.

20. The tank container of claim 16, wherein an inner flange of the adaptor is disposed at an acute angle relative to the outer flange.

* * * * *